US009844853B2

(12) United States Patent
Pacella et al.

(10) Patent No.: US 9,844,853 B2
(45) Date of Patent: Dec. 19, 2017

(54) ABRASIVE TOOLS AND METHODS FOR FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Nan Y. Pacella, Natick, MA (US); Lawrence J. Lavallee, Jr., Auburn, MA (US); Michael K. Montgomery, Marlborough, MA (US); Katherine M. Sahlin, Old Orchard Beach, ME (US)

(73) Assignee: SAINT-GOBAIN ABRASIVES, INC./SAINT-GOBAIN ABRASIFS, Worcester, MA (US)

( * ) Notice: Subject to any disclaimer, the term of this patent is extended or adjusted under 35 U.S.C. 154(b) by 24 days.

(21) Appl. No.: 14/985,041

(22) Filed: Dec. 30, 2015

(65) Prior Publication Data

US 2016/0184976 A1 Jun. 30, 2016

Related U.S. Application Data

(60) Provisional application No. 62/097,783, filed on Dec. 30, 2014.

(51) Int. Cl.
*B24B 1/00* (2006.01)
*B24D 11/00* (2006.01)
(Continued)

(52) U.S. Cl.
CPC ..... *B24D 18/00* (2013.01); *B24D 3/005* (2013.01); *B24D 5/12* (2013.01)

(58) Field of Classification Search
None
See application file for complete search history.

(56) References Cited

U.S. PATENT DOCUMENTS 2,209,716 A 7/1940 Crupi
2,307,461 A 1/1943 Guth
(Continued)

FOREIGN PATENT DOCUMENTS

CN 201052598 4/2008
CN 101318313 12/2008
(Continued)

OTHER PUBLICATIONS

Author Unknown, Feb. 9, 2016, Definition of "Bonded" and "bond" retrieved via Google Search.
(Continued)

*Primary Examiner* — Jennifer A. Smith
*Assistant Examiner* — Ross J Christie
(74) *Attorney, Agent, or Firm* — Abel Law Group, LLP; Thomas Osborn

(57) ABSTRACT

An abrasive tool can include a bonded abrasive including a body and a barrier layer bonded to a major surface of the body. The body can include abrasive particles contained within a bond material. The barrier material can include a metal-containing film. In an embodiment, the barrier layer may further include a polymer-containing film. In another embodiment, the barrier layer may include a biaxially oriented material. The abrasive tool may be formed such that the barrier layer is formed in-situ with the formation of the bonded abrasive.

20 Claims, 6 Drawing Sheets

(51) Int. Cl.

| | |
|---|---|
| ***B24D 18/00*** | (2006.01) |
| ***B24D 3/00*** | (2006.01) |
| ***B24D 5/12*** | (2006.01) |

(56) References Cited

U.S. PATENT DOCUMENTS

| | | | | |
|---|---|---|---|---|
| 2,398,224 | A | 4/1946 | Hackett | |
| 2,544,641 | A | 3/1951 | Coes, Jr. | |
| 3,053,384 | A | 9/1962 | Loomis | |
| 3,117,400 | A | 1/1964 | Martin | |
| 3,135,590 | A | 6/1964 | Campbell et al. | |
| 3,393,798 | A | 7/1968 | Beers | |
| 3,619,151 | A | 11/1971 | Sheets, Jr. et al. | |
| 3,686,800 | A | 8/1972 | Rue et al. | |
| 3,724,160 | A | 4/1973 | Rechberger | |
| 3,734,336 | A | 5/1973 | Rankow et al. | |
| 3,745,623 | A * | 7/1973 | Wentorf, Jr. | B01J 3/062 51/307 |
| 4,021,208 | A * | 5/1977 | Oberbichler | C09K 3/1409 51/295 |
| 4,036,360 | A | 7/1977 | Deffeyes | |
| 4,047,903 | A | 9/1977 | Hesse et al. | |
| 4,190,986 | A | 3/1980 | Kunimasa | |
| 4,239,501 | A | 12/1980 | Wirth et al. | |
| 4,255,165 | A * | 3/1981 | Dennis | B01J 3/062 51/295 |
| 4,294,357 | A | 10/1981 | Stevens et al. | |
| 4,369,046 | A * | 1/1983 | Bruschek | B24D 3/001 51/293 |
| 4,380,447 | A | 4/1983 | Vander Lugt, Jr. | |
| 4,871,376 | A | 10/1989 | DeWald | |
| 4,877,420 | A | 10/1989 | Buxbaum et al. | |
| 4,918,116 | A | 4/1990 | Gardziella et al. | |
| 4,947,990 | A | 8/1990 | Klemets | |
| 5,042,991 | A | 8/1991 | Kunz et al. | |
| 5,079,875 | A | 1/1992 | Unno et al. | |
| 5,116,392 | A | 5/1992 | Selgrad et al. | |
| 5,127,924 | A | 7/1992 | Russel | |
| 5,487,940 | A | 1/1996 | Bianchini et al. | |
| 5,505,950 | A | 4/1996 | Floyd et al. | |
| 5,626,945 | A | 5/1997 | Berzins et al. | |
| 5,692,950 | A * | 12/1997 | Rutherford | B24B 37/22 51/293 |
| 5,908,649 | A | 6/1999 | Floyd et al. | |
| 5,984,989 | A | 11/1999 | Davison et al. | |
| 6,003,674 | A | 12/1999 | Brooks | |
| 6,050,400 | A | 4/2000 | Taskis et al. | |
| 6,086,648 | A | 7/2000 | Rossettim, Jr. et al. | |
| 6,121,143 | A * | 9/2000 | Messner | B24B 37/04 51/295 |
| 6,214,067 | B1 | 4/2001 | Hanson | |
| 6,270,543 | B1 | 8/2001 | Gagliardi et al. | |
| 6,419,966 | B1 | 7/2002 | Davi | |
| 6,460,694 | B1 | 10/2002 | Khanna et al. | |
| 6,749,496 | B2 | 6/2004 | Mota et al. | |
| 6,764,574 | B1 | 7/2004 | Obeng | |
| 6,941,561 | B1 | 9/2005 | Kasichainula et al. | |
| 6,949,129 | B2 | 9/2005 | Simon | |
| 7,661,247 | B2 | 2/2010 | Schwabel et al. | |
| 8,021,449 | B2 | 9/2011 | Seth et al. | |
| 8,758,461 | B2 | 6/2014 | Yener et al. | |
| 2001/0002360 | A1 | 5/2001 | Shiga | |
| 2002/0050513 | A1 | 5/2002 | Player et al. | |
| 2004/0020133 | A1 * | 2/2004 | Paxton | B24D 11/02 51/295 |
| 2004/0173670 | A1 | 9/2004 | Snyder | |
| 2005/0133579 | A1 | 6/2005 | Smorch et al. | |
| 2005/0279028 | A1 | 12/2005 | Keipert | |
| 2006/0000731 | A1 | 1/2006 | Hayne et al. | |
| 2006/0003121 | A1 | 1/2006 | Scheller | |
| 2006/0265966 | A1 | 11/2006 | Rostal et al. | |
| 2007/0000214 | A1 * | 1/2007 | Schwabel | B24D 5/12 53/472 |
| 2007/0125674 | A1 | 6/2007 | Ficai | |
| 2008/0013198 | A1 | 1/2008 | Ma | |
| 2008/0202821 | A1 | 8/2008 | McClain et al. | |
| 2009/0017727 | A1 * | 1/2009 | Pribyl | B24D 3/28 51/298 |
| 2009/0022434 | A1 * | 1/2009 | Chiba | B01D 53/261 383/109 |
| 2009/0035519 | A1 * | 2/2009 | Gaeta | B24D 3/004 51/298 |
| 2009/0041983 | A1 * | 2/2009 | Gaeta | B24D 3/20 428/141 |
| 2011/0014055 | A1 | 1/2011 | Hertter et al. | |
| 2011/0053479 | A1 | 3/2011 | Kim et al. | |
| 2011/0097548 | A1 * | 4/2011 | Bhandari | B32B 15/082 428/164 |
| 2011/0155593 | A1 | 6/2011 | Zhang et al. | |
| 2012/0006818 | A1 | 1/2012 | Fester et al. | |
| 2012/0055096 | A1 * | 3/2012 | Goldsmith | B24D 11/02 51/298 |
| 2012/0167477 | A1 * | 7/2012 | Wang | B24D 3/00 51/295 |
| 2012/0252329 | A1 * | 10/2012 | Wald | B24D 3/00 51/293 |
| 2013/0260656 | A1 * | 10/2013 | Seth | B24B 37/26 51/296 |
| 2014/0004316 | A1 | 1/2014 | Zhang | |
| 2014/0256238 | A1 | 9/2014 | Van | |

FOREIGN PATENT DOCUMENTS

| | | | |
|---|---|---|---|
| CN | 201346747 | Y | 11/2009 |
| CN | 101623853 | A | 1/2010 |
| CN | 101804602 | | 8/2010 |
| CN | 103641967 | | 3/2014 |
| CN | 203460070 | | 3/2014 |
| CN | 103709349 | | 4/2014 |
| DE | 3138163 | A1 | 4/1983 |
| DE | 10032036 | A1 | 1/2002 |
| DE | 20117766 | U1 | 1/2002 |
| DE | 10139533 | | 2/2003 |
| DE | 10049317 | B4 | 11/2006 |
| EP | 0236877 | A2 | 9/1987 |
| EP | 0770457 | A1 | 5/1997 |
| EP | 0904955 | A1 | 3/1999 |
| EP | 1795463 | A2 | 6/2007 |
| EP | 2361851 | | 8/2011 |
| GB | 696379 | | 8/1953 |
| GB | 701431 | | 12/1953 |
| GB | 781351 | | 8/1957 |
| GB | 1151935 | A | 5/1969 |
| GB | 1249050 | A | 10/1971 |
| JP | H01246078 | | 10/1989 |
| JP | H02232171 | | 9/1990 |
| JP | H06126638 | | 5/1994 |
| JP | H07309375 | A | 11/1995 |
| JP | 2001088036 | A | 4/2001 |
| JP | 2002370750 | A | 12/2002 |
| JP | 2005029211 | A | 2/2005 |
| JP | 2005272009 | A | 10/2005 |
| JP | 2005319556 | | 11/2005 |
| JP | 2007039096 | A | 2/2007 |
| JP | 2008013198 | A | 1/2008 |
| JP | 2008037066 | A | 2/2008 |
| JP | 4199126 | B2 | 12/2008 |
| JP | 2009500250 | A | 1/2009 |
| JP | 4410213 | | 2/2010 |
| KR | 100537092 | B1 | 12/2005 |
| KR | 1020080031221 | A | 4/2008 |
| NO | 19800001902 | A | 12/1980 |
| RU | 2205738 | C2 | 6/2003 |
| SU | 472783 | | 6/1975 |
| TW | 201119799 | | 6/2011 |
| WO | 9959778 | A1 | 11/1999 |
| WO | 0228980 | A2 | 4/2002 |
| WO | 2007005628 | A1 | 1/2007 |
| WO | 2008057045 | A | 5/2008 |

(56) References Cited

FOREIGN PATENT DOCUMENTS

| | | | |
|---|---|---|---|
| WO | 2008103417 | A1 | 8/2008 |
| WO | 2009084776 | A | 7/2009 |

OTHER PUBLICATIONS

International Search Report, from PCT/US2015/068166 dated Apr. 19, 2016.
International Search Report , from International application No. PCT/US2016/069483 dated Apr. 11, 2017.
Tyrolit product packaging, 2009.
International Search Report, from PCT/US2010/062421 dated Jul. 28, 2011.

* cited by examiner

ABRASIVE TOOLS AND METHODS FOR FORMING SAME

CROSS-REFERENCE TO RELATED APPLICATION(S)

This application claims priority under 35 U.S.C. §119(e) to U.S. Patent Application No. 62/097,783 entitled "ABRASIVE TOOLS AND METHODS FOR FORMING SAME," by Nan Y. PACELLA et al., filed Dec. 30, 2014, which is assigned to the current assignee hereof and incorporated herein by reference in its entirety.

BACKGROUND OF THE INVENTION

Field of the Disclosure

The present invention relates in general to abrasive tools and, in particular, to a bonded abrasive including a barrier layer.

Description of the Related Art

Bonded abrasive articles can be prepared by blending abrasive grains with a bond and optional additives and shaping the resulting mixture, using, for instance, a suitable mold. The mixture can be shaped to form a green body which can be thermally processed, for example, by curing, to produce an article in which the abrasive grains are held in a three dimensional bond matrix. Among bonded abrasive tools, various bond matrix materials exist, including for example organic materials, such as resin. Some resin-based bond matrix materials may be susceptible to water absorption, which may degrade the performance of the abrasive article. A need for improved abrasive articles continues to exist.

BRIEF DESCRIPTION OF THE DRAWINGS

Embodiments are illustrated by way of example and are not limited in the accompanying figures.

Figure 1:
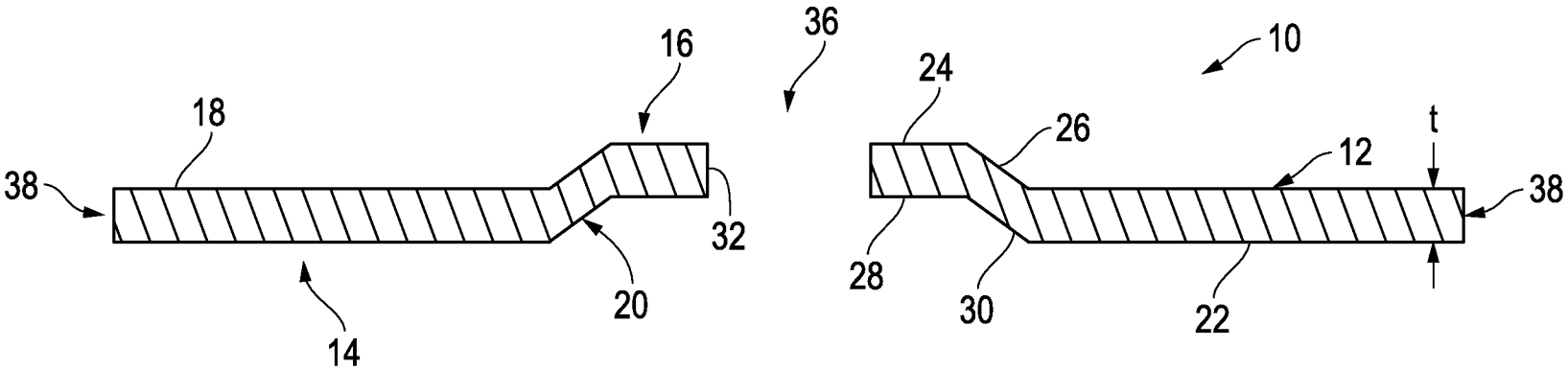
FIG. 1 includes a cross-sectional view of an abrasive tool, such as a bonded abrasive wheel bonded abrasive, in accordance with an embodiment described herein.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

Embodiments disclosed herein are related to abrasive tools including a bonded abrasive and a barrier layer. The bonded abrasive can include a body including abrasive particles contained within a bond material. In an embodiment, the barrier layer can be bonded to a major surface of the body. The barrier layer may facilitate reduced absorption of certain materials, including water and/or water vapor during storage, shipment, and/or use to reduce aging of the bond matrix material. The barrier layer may facilitate improved life and performance of the abrasive article by reducing the absorption of certain species of materials, such as water vapor, which may reduce degradation of the bond matrix material.

Some other embodiments are directed to a method of forming the abrasive tool in which the barrier layer is formed in-situ with the formation of the bonded abrasive. As used herein, in-situ is intended to mean during the formation of the bonded abrasive. Particularly, when an organic material is used to form the bond material of the bonded abrasive, in-situ means during the curing of the organic material.

The abrasive tool disclosed herein includes the bonded abrasive. In specific implementations, the bonded abrasive can include any suitable type of abrasive wheel as known in the art, including thin disc shaped abrasive articles. For example, the bonded abrasive wheel can be a depressed center wheel, such as, for example, ANSI (American National Standards Institute) Type 27, Type 28 or Type 29 wheels, or European Standard (EN 14312) Type 42 wheel. In particular embodiments, the bonded abrasive tool can include Type 41 or Type 1 wheels, which may be referred to as straight wheels, having no depression in the interior but having the same contour and extending along the same plane along the length of the diameter of the wheel. Still, essentially any bonded abrasive wheel construction may be utilized with the present embodiments. Moreover, the abrasive tools may be in the form of cut-off wheels.

Shown in FIG. 1A, for instance, is a cross-sectional view of depressed center of a bonded abrasive 10, which can include a body including a rear (top) face 12 and a front (bottom) face 14. The rear face 12 can include a raised hub region 16 and outer flat rear wheel region 18. The front face 14 can include a depressed center region 20 and outer flat front wheel region 22 (which provides the working surface of the wheel). In turn, raised hub region 16 can have raised hub surface 24 and back sloping (or slanted) surface 26; depressed center region 20 can include depressed center 28 and front sloping (or slanted) surface 30. The body of the bonded abrasive 10 can have central opening 32 for mounting the bonded abrasive 10 on the rotating spindle of a tool, e.g., a hand-held angle grinder. During operation, the bonded abrasive 10 can be secured by mounting hardware (not shown in FIG. 1A) such as, for instance, a suitable flange system. The bonded abrasive 10 can also be part of an integrated arrangement that includes mounting hardware.

The body of the bonded abrasive 10 can have a thickness "t" that can be measured at various positions, including at the periphery of the bonded abrasive body. The thickness of the body of the bonded abrasive 10 can be the same or essentially the same along a radial direction from the central opening 36 to the outer edge (periphery) 38 of the bonded abrasive 10. In other designs, the thickness "t" of the body can vary (can increase or decrease) along a radial distance from the central opening 36 to the periphery 38. For example, the body of the bonded abrasive 10 can have a thickness "t" of at least 0.8 mm, such as, at least 0.9 mm, at least 1 mm, at least 1.2 mm, at least 1.3 mm, at least 1.5 mm, at least 1.8 mm, at least 2 mm, at least 2.2 mm, at least 2.5 mm, at least 2.8 mm, at least 3 mm, at least 3.2 mm, at least 3.5 mm, at least 3.8 mm, at least 4 mm, at least 4.2 mm, at least 4.5 mm, at least 4.8 mm, or even at least 5 mm. In another non-limiting embodiment, the thickness "t" of the body of the bonded abrasive 10 can be not greater than 20 mm, such as not greater than 18 mm, not greater than 16 mm, not greater than 15 mm, not greater than 12 mm, not greater than 10 mm, not greater than 9 mm, not greater than 8 mm, not greater than 7 mm, not greater than 6 mm, not greater than 5.8 mm, not greater than 5.5 mm, not greater than 5.2 mm, not greater than 5 mm, not greater than 4.5 mm, not greater than 4 mm, not greater than 3.5 mm, or even not greater than 3 mm. It will be appreciated that the body of the bonded abrasive 10 can have a thickness "t" within a range including any of the minimum and maximum values noted above, including for example, within a range including 0.8 mm to 20 mm, such as a range of 0.8 mm to 15 mm, or even a range of 0.8 mm to 10 mm.

In certain alternative embodiments, the body of the bonded abrasive may utilize a patterned working surface, wherein the working surface is a major surface (e.g., a front (bottom) face 14) of the abrasive tool intended to contact the workpiece and conduct the material removal operation. Shown in FIG. 1B, for instance, is a front view of a wheel 150, having mounting hole 155, center region 151, and working surface 153, which can be patterned to have an array of protrusions 157 that are separated by recesses (or channels) 159. It will be appreciated that any arrangement, distribution, or pattern may be utilized with any of the embodiments herein.

In an alternative embodiment, the bonded abrasive can have a working surface that is essentially free of patterned features. FIG. 1C, for instance, shows a front view of a body of a bonded abrasive 100, having center region 101, a mounting hole 105, and working surface 103, which is substantially smooth (i.e., not patterned). In other words, the working surface 103 does not have protrusions or channels (recesses).

Furthermore, it will be appreciated that certain bonded abrasives, which are in the form of bonded abrasive wheels having a bonded abrasive body, can be used as cutting tools, wherein the peripheral surface of the body is used for abrasive material removal operations. In such instances, the major surfaces of the body, such as the working surfaces 153 and 103 of FIGS. 1B and 1C, respectively, are not necessarily used to conduct the material removal operations. Instead, the outer peripheral surface (e.g., peripheral surface 161 of FIG. 1B or peripheral surface 107 of FIG. 1C) of the body can be configured to contact a surface of the workpiece and conduct the material removal operations. Such abrasive tools may be cut-off thin wheels and the like.

Further, the body of the bonded abrasive of the embodiments herein can include a diameter, which defines the length of extending between two points on the perimeter and through the center of the circular body as viewed top down. In a non-limiting embodiment, the diameter can be at least 50 mm, such as at least 55 mm, at least 60 mm, at least 65 mm, at least 70 mm, or even at least 75 mm. In another non-limiting embodiment, the diameter may be not greater than 400 mm, such as, not greater than 350 mm, not greater than 300 mm, not greater than 275 mm, not greater than 230 mm, not greater than 200 mm, or even not greater than 150 mm. It will be appreciated that the diameter of the bonded abrasive body can be within a range including any of the minimum to maximum values noted above, for example, within a range of 50 mm to 400 mm, such as within a range of 50 mm to 230 mm, 75 mm to 230 mm, or even within a range of 75 mm to 150 mm.

The body of the bonded abrasive may have a particular aspect ratio, which is a ratio of the diameter (D) of the body to the thickness (t) of the body (diameter:thickness) that may facilitate certain abrasive operations. For example, the body can have an aspect ratio of at least 10:1, at least 15:1, at least 20:1, at least 35:1, at least 50:1, at least 75:1, at least 100:1, or even at least 125:1. In other instances, the body of the bonded abrasive can have an aspect ratio (diameter:thickness) of not greater than 125:1, not greater than 100:1, not greater than 75:1, not greater than 50:1, not greater than 35:1, not greater than 25:1, not greater than 20:1, or not greater than 15:1. The ratio can be within a range including any of the above minimum and maximum values, such as within a range of 125:1 to 15:1, such as 100:1 to 30:1. However, the invention can be practiced with wheels having different dimensions and different ratios between dimensions. For example, the thin-wheel abrasive article also can have a desirable aspect ratio within a range of 5 to 160, such as within a range of 15 to 160, within a range of 15 to 150, or even within a range of 20 to 125.

The bonded abrasive of the embodiments herein can have certain constructions. It will be appreciated that the body of the embodiments herein may be monolithic articles formed of a single layer having a single construction, having a substantially uniform grade and structure throughout the volume of the body of the bonded abrasive. Alternatively, the body of the embodiments herein can be composite bodies having one or more layers, wherein at least two of the layers are different from each other based on a characteristic such as, abrasive particle type, content of abrasive particles, porosity type (e.g., closed or open), content of porosity, type of bond material, content of bond material, distribution of abrasive particles, hardness, flexibility, filler content, filler materials, shape of the layer, size (e.g., thickness, width, diameter, circumference, or length) of the layer, construction of the layer (e.g., solid, woven, non-woven, etc.) and a combination thereof.

Abrasive Particles

Bonded abrasives such as bonded abrasive wheels with or without a reinforcing layer, including depressed center wheels, can be prepared by including one or more types of abrasive particles or grains, a bond material (e.g., an organic material (resin) or an inorganic material), and in many cases other ingredients, such as, for instance, active or inactive fillers, processing aids, lubricants, crosslinking agents, antistatic agents and so forth.

Abrasive particles can include inorganic materials, organic materials, naturally occurring materials (e.g., minerals), superabrasive materials, synthesized materials (e.g., polycrystalline diamond compacts) and a combination thereof. Some suitable exemplary abrasive particles can include oxides, carbides, carbon-based materials, nitrides, borides, oxycarbides, oxynitrides, oxyborides, and a combination thereof. A particular example can include alumina-based abrasive particles. As used herein, the term "alumina," "$Al_2O_3$" and "aluminum oxide" are used interchangeably. Specific examples of suitable alumina-based abrasive grains which can be employed in the present invention include white alundum grain, from Saint-Gobain Ceramics & Plastics, Inc. or pink alundum, from Treibacher Schleifmittel, AG, mono-crystal alumina, coated or non-coated brown fused alumina, heat-treated alumina, silicon carbide, and a combination thereof.

Other abrasive particles can include seeded or unseeded sintered sol gel alumina, with or without chemical modification, such as rare earth oxides, MgO, and the like can be utilized. In yet another embodiment, the abrasive particles for use in the bonded abrasive can include silica, alumina (fused or sintered), zirconia, alumina-zirconia, silicon carbide, garnet, boron-alumina, diamond, cubic boron nitride, aluminum-oxynitride, ceria, titanium dioxide, titanium diboride, boron carbide, tin oxide, tungsten carbide, titanium carbide, iron oxide, chromia, flint, emery, bauxite, and utilized combination thereof.

The abrasive particles also can include various shapes, structures, and/or configurations. For example, the abrasive particle can be a shaped abrasive particle. Shaped abrasive particles can have a well-defined and regular arrangement (i.e., non-random) of edges and sides, thus defining an identifiable and controlled shape. Moreover, shaped abrasive particles are distinct from traditional crushed or non-shaped abrasive particles as the shaped abrasive particles have substantially the same shape with respect to each other, wherein traditional crushed abrasive particles vary significantly in their shape with respect to each other. For example, a shaped abrasive particle may have a polygonal shape as viewed in a plane defined by any two dimensions of length, width, and height (e.g., viewed in a plane defined by a length and a width). Some exemplary polygonal shapes can be triangular, quadrilateral (e.g., rectangular, square, trapezoidal, parallelogram), a pentagon, a hexagon, a heptagon, an octagon, a nonagon, a decagon, and the like. Additionally, the shaped abrasive particle can have a three-dimensional shape defined by a polyhedral shape, such as a prismatic shape or the like. Further, the shaped abrasive particles may have curved edges and/or surfaces, such that the shaped abrasive particles can have convex, concave, ellipsoidal shapes. Exemplary shaped abrasive particles are disclosed in U.S. Pat. No. 8,758,461, which is incorporated herein in its entirety.

The shaped abrasive particles can be in the form of any alphanumeric character, e.g., 1, 2, 3, etc., A, B, C. etc. Further, the shaped abrasive particles can be in the form of a symbol, trademark, a character selected from the Greek alphabet, the modern Latin alphabet, the ancient Latin alphabet, the Russian alphabet, any other alphabet (e.g., Kanji characters), and any combination thereof.

The size of abrasive particles can be expressed as a grit size, and charts showing a relation between a grit size and its corresponding average particle size, expressed in microns or inches, are known in the art as are correlations to the corresponding United States Standard Sieve (USSS) mesh size. Particle size selection depends upon the application or process for which the abrasive tool is intended and may range from 10 to 325 as per ANSI grit size designation. Specifically, grit sizes may range from 16 to 120 or 16 to 80.

According to one particular embodiment, the abrasive particles can have an average particle size (D50) of at least 1 micron, such as at least 10 microns, at least 20 microns, at least 30 microns or at least 40 microns. Still, in another non-limiting embodiment, the abrasive particles can have an average particle size of not greater than 2 mm, such as not greater than 1 mm, not greater than 800 microns, not greater than 600 microns, not greater than 500 microns, not greater than 400 microns, not greater than 300 microns, not greater than 280 microns, not greater than 250 microns, not greater than 200 microns. It will be appreciated that the abrasive particles can have an average particle size within a range including any of the minimum and maximum values noted above, including for example, within a range between 1 micron and 2 mm, within a range between 10 microns and 1 mm, or even within a range between 20 microns and 200 microns.

Bond Material

The abrasive tool of the present invention, as well as the methods of making and using the abrasive tool, can include various bond materials and precursor bond materials. In specific implementations of the present invention, at least one of the bond material and the precursor bond material is an organic material, also referred to as a "polymeric" or "resin" material, which may be formed into the finally-formed bond material by curing. An example of an organic bond material that can be employed to fabricate bonded abrasive articles can include a phenolic resin. Such resins can be obtained by polymerizing phenols with aldehydes, in particular, formaldehyde, paraformaldehyde or furfural. In addition to phenols, cresols, xylenols and substituted phenols can be employed. Comparable formaldehyde-free resins also can be utilized. Examples of other suitable organic bond materials include epoxy resins, polyester resins, polyurethanes, polyester, rubber, polyimide, polybenzimidazole, aromatic polyamide, modified phenolic resins (such as: epoxy modified and rubber modified resins, or phenolic resin blended with plasticizers, etc.), and so forth, as well as mixtures thereof.

Among phenolic resins, resoles can be obtained by a one-step reaction between aqueous formaldehyde and phenol in the presence of an alkaline catalyst. Novolac resin, also known as a two-stage phenolic resin, can be produced under acidic conditions and during milling process blended with a cross-linking agent, such as hexamethylenetetramine (often also referred to as "hexa"). Exemplary phenolic resins can include resole and novolac. Resole phenolic resins can be alkaline catalyzed and have a ratio of formaldehyde to phenol of greater than or equal to one, such as from 1:1 to 3:1. Novolac phenolic resins can be acid catalyzed and have a ratio of formaldehyde to phenol of less than one, such as from 0.5:1 to 0.8:1.

The bond material can contain more than one phenolic resin, including for example, at least one resole and at least novolac-type phenolic resin. In many cases, at least one phenol-based resin is in liquid form. Suitable combinations of phenolic resins are described, for example, in U.S. Pat. No. 4,918,116 to Gardziella, et al., the entire contents of which are incorporated herein by reference.

An epoxy resin can include an aromatic epoxy or an aliphatic epoxy. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, 4,4'-(9-fluorenylidene)diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The external phase can include one or more aliphatic epoxies. An example of an aliphatic epoxy includes glycidyl ether of C2-C30 alkyl; 1,2 epoxy of C3-C30 alkyl; mono or multi-glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures.

An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl) hexanedioate, di(3,4-epoxy-6methylcyclohexylmethyl) hexanedioate, ethylenebis(3,4-epoxycyclohexanecarboxylate), ethanedioldi(3,4-epoxycyclohexylmethyl) ether, or 2-(3,4-epoxycyclohexyl-5,5-spiro-3,4-epoxy)cyclohexane-1,3-dioxane.

An exemplary multifunctional acrylic can include trimethylolpropane triacrylate, glycerol triacrylate, pentaerythritol triacrylate, methacrylate, dipentaerythritol pentaacrylate, sorbitol triacrylate, sorbital hexacrylate, or any combination thereof. In another example, an acrylic polymer can be formed from a monomer having an alkyl group having from 1-4 carbon atoms, a glycidyl group or a hydroxyalkyl group having from 1-4 carbon atoms. Representative acrylic polymers include polymethyl methacrylate, polyethyl methacrylate, polybutyl methacrylate, polyglycidyl methacrylate, polyhydroxyethyl methacrylate, polymethyl acrylate, polyethyl acrylate, polybutyl acrylate, polyglycidyl acrylate, polyhydroxyethyl acrylate and mixtures thereof.

Curing or cross-linking agents that can be utilized depend on the bonding material selected. For curing phenol novolac resins, for instance, a typical curing agent is hexa. Other amines, e.g., ethylene diamine; ethylene triamine; methyl amines and precursors of curing agents, e.g., ammonium hydroxide which reacts with formaldehyde to form hexa, also can be employed. Suitable amounts of curing agent can be within the range, for example, of from 5 to 20 parts, or 8 parts to 15 parts, by weight of curing agent per hundred parts of total novolac resin. It will be appreciated that the ratio can be adjusted based on various factors, including for example the particular types of resins used, the degree of cure needed, and the desired final properties for the articles, such as strength, hardness, and grinding performance.

Reinforcing Layer

According to one embodiment, the bonded abrasive can be reinforced with one or more, (e.g., two or three) reinforcing layers, which may be in the form of layers, partial layers, discrete bundles of material distributed throughout the bond material, and a combination thereof. As used herein, the term "reinforcing layer" can refer to a discrete component that can be made of a material that is different from the bond material and abrasive particles utilized to make the abrasive layers within the bonded abrasive body. In an embodiment, the reinforcing layer does not include abrasive particles. With respect to the thickness of the bonded abrasive, a reinforcing layer can be embedded within the body of the bonded abrasive and such bonded abrasives may be referred to as "internally" reinforced. A reinforcing layer also can be close to, or attached to the front and/or back face of the body of the bonded abrasive. Several reinforcing layers can be disposed at various depths through the thickness of the bonded abrasive.

Certain reinforcing layers may have a circular geometry. The outer periphery of the reinforcing layer also can have a square, hexagon or another polygonal geometry. An irregular outer edge also can be used. Suitable non-circular shapes that can be utilized are described in U.S. Pat. Nos. 6,749,496 and 6,942,561, incorporated herein by reference in their entirety. In certain instances wherein the bonded abrasive is in the form of a wheel or disc, the reinforcing layer can extend from the inner diameter (edge of the central opening) to the outermost edge (i.e., peripheral surface) of the bonded abrasive body. Partial reinforcing layers can be employed and in such cases, the reinforcing layer may extend, for example, from the mounting hole to at least 30% along the radius or, for non-circular shapes, along the equivalent of the largest "radius" of the bonded abrasive body. For example, a partial reinforcing layer can extend for at least 60%, at least 70%, at least 75%, at least 80%, at least 85%, at least 90%, at least 95%, or even at least 99% along the radius or, for non-circular shapes, along the equivalent of the largest "radius" of the body of the bonded abrasive. In another non-limiting embodiment, the partial reinforcing layer may extend for not greater than 100%, such as not greater than 99%, not greater than 97%, not greater than 95%, not greater than 90%, not greater than 85%, not greater than 80%, not greater than 70%, or even not greater than 60% along the radius or the equivalent of the largest "radius" of the bonded abrasive body. It will be appreciated that the partial reinforcing layer can extend within a range including any of the minimum and maximum values noted above. For instance, the partial reinforcing layer can extend within a range of 60% to 100%, such as, within a range of 70% to 99%, or within a range of 80% to 90% along the radius or the equivalent of the largest "radius" of the bonded abrasive body The reinforcing layer can include various materials, including a single material or more than one type of material, such as a composite material. Moreover, a bonded abrasive of the embodiments herein can use a single type of reinforcing layer or may use different types of reinforcing layers, which can employ different materials with respect to each other. Some suitable reinforcing layer materials can include woven materials or non-woven materials. In at least one embodiment, the reinforcing layer can include a glass material, including but not limited to a fiberglass material. In yet other embodiments, the reinforcing layer can include, a fiber (e.g., Kevlar®), basalt, carbon, fabric organic materials (e.g., elastomers, rubbers), combinations of materials and so forth. An exemplary reinforcing layer can include a polymeric film (including primed films) including for example, a polyolefin film (e.g., polypropylene including biaxially oriented polypropylene), a polyester film (e.g., polyethylene terephthalate), a polyamide film, a cellulose ester film, a metal foil, a mesh, a foam (e.g., natural sponge material or polyurethane foam), a cloth (e.g., cloth made from fibers or yams comprising fiberglass, polyester, nylon, silk, cotton, poly-cotton, or rayon), a paper, a vulcanized paper, a vulcanized rubber, a vulcanized fiber, a nonwoven material, or any combination thereof, or treated versions thereof. A cloth backing can be woven or stitch bonded. In particular examples, the reinforcing layer is selected from a group consisting of paper, polymer film, cloth, cotton, poly-cotton, rayon, polyester, poly-nylon, vulcanized rubber, vulcanized fiber, fiberglass fabric, metal foil or any combination thereof. In other examples, the reinforcing layer includes a woven fiberglass fabric. In a particular example, the bonded abrasive can include one more layers of fiberglass between which a blend abrasive grains or particles are bound in a bond material such as a polymer matrix. Using reinforcing layers also can allow for shear at the interface between the reinforcing layer and adjacent region(s) of the bonded abrasive (which contain abrasive grains or particles distributed in a three dimensional bond material matrix). It will be appreciated that a reinforcing layer can consist essentially of any of the foregoing materials or consists essentially of two or more of the foregoing materials noted above.

In specific examples, the body of the bonded abrasive can include at least one or more fiberglass reinforcing layers, provided, for instance, in the form of fiberglass web(s). Fiberglass webs can include fiberglass woven from very fine fibers of glass. Fiberglass web can include leno or plain woven. The fiberglass utilized can include E-glass (alumino-borosilicate glass with less than 1 wt % alkali oxides). Other types of fiberglass can include, for example, A-glass (alkali-lime glass with little or no boron oxide), E-CR-glass (alumino-lime silicate with less than 1 wt % alkali oxides, with high acid resistance), C-glass (alkali-lime glass with high boron oxide content, used for example for glass staple fibers), D-glass (borosilicate glass with high dielectric constant), R-glass (alumino silicate glass without MgO and CaO with high mechanical requirements), or S-glass (alumino silicate glass without CaO but with high MgO content with high tensile strength).

Fiberglass webs can be arranged in the bonded abrasive such as a bonded abrasive wheel in any suitable manner. In certain implementations, placement of a glass fiber web at the working face of the wheel may be avoided. Any of the embodiments herein can be reinforced with at least one fiberglass web having a hole corresponding to the mounting hole of the wheel and the same diameter as the wheel. Partial web reinforcing layers that extend from the mounting hole through some but not the total radius of the wheel also can be used, as can be other web reinforcement placements.

The reinforcing layer can be characterized by one or more of the following physical parameters: weight ($g/m^2$), thickness (mm), openings per cm and tensile strength (MPa), which can be further delineated with respect to the tensile strength of the warp (the long web components that run continuously for the length of the roll) and the tensile strength of the fill (the short components that run crosswise to the roll direction). In certain instances, one or more of the fiberglass webs employed has a minimum tensile strength of at least 200 MPa. Other factors include filament diameter, amount of coating, for instance, the coverage of the web with coating and others, as known in the art.

Chemical parameters can relate to the chemistry of the coating provided on the fiberglass web. Generally, there are two types of chemical "coatings." A first coating, referred to as "sizing," can be applied to the glass fiber strands immediately after they exit the bushing and include ingredients such as film formers, lubricants, silanes, which for example, can be dispersed in water. The sizing can provide protection of the filaments from processing-related degradation (such as abrasion). It can also provide abrasion protection during secondary processing such as weaving into a web. Strategic manipulation of properties associated with the first coating (sizing) can affect the compatibility of the glass fibers with the second coating, which, in turn, can affect compatibility of the coating with the resin bond. The second coating can be applied to the glass web and traditionally includes wax, used primarily to prevent "blocking" of the webs during shipping and storage. In many cases, the second coating can be compatible with both the sizing (first coating) and the matrix resin for which the reinforcement is intended.

Bonded abrasives such as bonded abrasive wheel tools with or without one or more reinforcing layers can be prepared by combining abrasive grains or particles, a bond material, e.g., an organic material (resin) or an inorganic material, and in many cases other ingredients, such as, for instance, fillers, processing aids, lubricants, crosslinking agents, antistatic agents and so forth.

The various ingredients can be added in any suitable order and blended using known techniques and equipment such as, for instance, Eirich mixers, e.g., Model RV02, Littleford, bowl-type mixers and others. The resulting mixture can be used to form a green body. As used herein, the term "green" refers to a body which maintains its shape during the next process step, but generally does not have enough strength to maintain its shape permanently. Green may also refer to a body that is unfinished, or that there are further processes yet to be completed before transforming the green body to a finally-formed bonded abrasive. For example, a resin bond present in the green body is in an uncured or unpolymerized state. The green body preferably is molded in the shape of the desired article, including for example, a bonded abrasive wheel (cold, warm or hot molding).

One or more reinforcing layers can be incorporated in the green body. For example, a first portion of a mixture containing one or more types of abrasive grains or particles and a bond material can be placed and distributed at the bottom of an appropriate mold cavity and then covered with a first reinforcing layer. A second portion of the bond/abrasive mixture can then be disposed and distributed over the first reinforcing layer. Additional reinforcing layers and/or bond/abrasive mixture layers can be provided, if so desired. The amounts of mix added to form a particular layer thickness can be modified as suitable for the intended purposes of the abrasive article. Other suitable sequences and/or techniques can be employed to shape the reinforced green body. For instance, a piece of paper or a fiberglass mesh or web or a piece of paper with a fiber glass mesh or web may be inserted in the mold cavity before the first mixture.

In some arrangements, the layers containing one or more types of abrasive particles and bond material (also referred herein as "abrasive layers") can differ from one another with respect to one or more characteristics such as, for instance, layer thickness, layer formulation (e.g., amounts and or types of ingredients being employed, grit size, grit shape, porosity), filler materials, bond composition, bond content, abrasive content, abrasive particle composition, porosity, pore size, porosity distribution, porosity type (i.e., closed and/or open porosity) and the like.

To form the bonded abrasive, such as a bonded abrasive wheel, a first abrasive layer, $a_1$ (containing abrasive particles and bond material), is laid in the mold. A first reinforcing layer $V_1$ is disposed on the first abrasive layer $a_1$, followed by a second abrasive layer, $a_2$, which can be the same or different from the first abrasive layer, $a_1$. A second reinforcing layer, $V_2$ (which can be the same or different from $V_1$), can be disposed over the second abrasive layer, $a_2$. If desired, a third abrasive layer, $a_3$, that includes abrasive particles and bond material can be used to cover the second reinforcing layer, $V_2$. The third abrasive layer $a_3$ can be the same or different with respect to one or more of the abrasive layers $a_1$ and/or $a_2$. Additional reinforcing layers and abrasive layers can be added, essentially as described, to obtain the desired number of abrasive layers and reinforcing layers. In another approach, a first reinforcing layer $V_1$ is placed at the bottom of the mold and covered by a first abrasive layer $a_1$, with additional abrasive layers and reinforcing layers being disposed as described above. Arrangements in which adjacent abrasive layers $a_n$ and $a_{n+1}$ are not separated by a reinforcing layer also are possible, as are those in which two or more reinforcing layers, e.g., $V_n$ and $V_{n+1}$, are not separated by an abrasive layer. Labels made of paper or polymer may also be affixed to major faces of the wheel. These labels may be used to identify the wheels. They may be affixed to the wheel during the abrasive wheel formation process or applied after curing.

The individual thickness of the mix layers can be substantially the same. In certain instances, the thickness of the mix layers can be different. The difference in thickness between any two of the mix layers may be calculated by using formula $[(\text{tab}\mathbf{1}-\text{tab}\mathbf{2})/\text{tab}\mathbf{1}]\times 100\%$, wherein tab1 is the greater thickness of the thicknesses of the two mix layers and tab2 is the smaller thickness with respect to tab1. For example, the difference in thickness between two abrasive layers can be at least 5% different, at least 10% different, at least 20% different, at least 25% different, at least 30% different, or even at least 50% different. Engineered differences in the thicknesses between two abrasive layers can promote certain mechanical properties and advantages in grinding performance. In addition or alternatively to thickness variations, abrasive layers and/or reinforcing layers may differ with respect to formulation, materials employed and/or other properties.

Filler

Any of the abrasive layers of the embodiments herein may include one or more fillers, which can be contained within the bond. According to an embodiment, the filler can include powders, granules, spheres, fibers, or a combination thereof. In another embodiment, the filler can include an inorganic material, an organic material, or a combination thereof. For example, suitable fillers can include sand, silicon carbide, bubble alumina, bauxite, chromites, magnesite, dolomites, bubble mullite, borides, titanium dioxide, carbon products (e.g., carbon black, coke or graphite), wood flour, clay, talc, hexagonal boron nitride, molybdenum disulfide, feldspar, nepheline syenite, glass fibers, glass spheres, $CaF_2$, $KBF_4$, Cryolite ($Na_3AlF_6$), potassium cryolite ($K_3AlF_6$), pyrites, ZnS, copper sulfide, mineral oil, fluorides, carbonates, calcium carbonate, or a combination thereof. In a further embodiment, the filler can include an antistatic agent, a metal oxide, a lubricant, a porosity inducer, a coloring agent, or a combination thereof. Examples of the lubricants can include stearic acid, glycerol monostearate, graphite, carbon, molybdenum disulfide, wax beads, calcium carbonate, calcium fluoride, or any combination thereof. Examples of the metal oxides can include lime, zinc oxide, magnesium oxide, or any combination thereof.

Note that fillers may be functional, such as, grinding aids, lubricants, and porosity inducers. In alternative instances, the fillers can be used for functional and/or aesthetics, such as a coloring agent. According to an embodiment, the filler can be distinct from the abrasive particles. In yet another embodiment, the filler can include secondary abrasive grains.

In an embodiment, the amount of filler can be at least 1 part per weight of the entire weight of the entire composition, such as at least 2 parts, at least 3 parts, at least 4 parts, or even at least 5 parts. In another embodiment, the amount of the filler may be not greater than 30 parts, such as not greater than 28 parts, not greater than 27 parts, or event not greater than 25 parts by weight, based on the weight of the entire composition. It will be appreciated that the amount of the filler can be within a range including any of the minimum to maximum values noted above. For example, the amount of the filler can be within a range of 1 and 30 parts, such as 2 parts to 28 parts, or 5 to 25 parts by weight, based on the weight of the entire composition.

The bonded abrasive or mix layer(s) thereof, can be formed to include at least 20 vol % bond material of the total volume of the bonded abrasive (or a specific mix layer). A greater content of bond material, such as at least 30 vol % at least 40 vol %, at least 50 vol %, or even at least 60 vol % can be utilized. With respect to abrasive grains, the bonded abrasive (or a given mix layer thereof) contains at least 20 vol % abrasive grains, such as at least 35 vol %, at least 45 vol %, at least 55 vol %, at least 60 vol %, or at least 65 vol %.

The bonded abrasive body described herein can be fabricated to have a certain porosity. The porosity can be set to provide a particular performance of the bonded abrasive, including parameters such as hardness, strength, and initial stiffness, as well as chip clearance and swarf removal. Porosity can be uniformly or non-uniformly distributed throughout the body of the bonded abrasive and can be intrinsic porosity, obtained by the arrangement of grains within the bond matrix, shape of the abrasive grains and/or bond precursors being utilized, pressing conditions, curing conditions and so forth, or can be generated by the use of pore inducers. Both types of porosity can be present.

The porosity can be closed and/or interconnected (open). In "closed" type of porosity, the pores are generally discrete with respect to each other and are not interconnected. In contrast, "open" porosity presents pores that are interconnected to one another creating an interconnected network of channels.

The finally-formed bonded abrasives may contain porosity of at least 0.1 vol %, such as at least 1 vol %, at least 2 vol %, at least 3 vol %, or even at least 5 vol % based on the total volume of the abrasive layers in the body of the bonded abrasive. In another non-limiting embodiment, the porosity may be not greater than 40 vol %, such as not greater than 35 vol %, not greater than 30 vol %, not greater than 25 vol %, or not greater than 20 vol %, not greater than 15 vol %, not greater than 10 vol %, or even not greater than 5 vol % for the total volume of abrasive layers within the body of the bonded abrasive. It will be appreciated that the porosity of the bonded abrasive can be within a range including any of the minimum and maximum values noted above, such as within the range of from 0 vol % to 40 vol %. For instances, the porosity of the bonded abrasives described herein (or of a mix layer thereof) can be within a range of from 0 vol % to 30 vol %, e.g., within a range between 1 vol % and 25 vol %, or between 5 vol % and 25 vol %.

Techniques that can be used to produce the bonded abrasive, including for example a bonded abrasive wheel with or without a reinforcing layer, can include, cold pressing, warm pressing, or hot pressing. In accordance with a particular embodiment the process of forming the abrasive articles herein can include cold pressing. In cold pressing, the materials in the mold are maintained at approximately ambient temperature, such as less than 30° centigrade (C). Force can be applied to the materials in the mold. For example, the applied force can be at least 40 tons. The applied force may be not greater than 2000 tons. The applied force can be within a range of 100 tons to 2000 tons. Alternatively, pressure can be applied to the materials by suitable means, such as a hydraulic press. The pressure applied can be, for example, in the range of 4.2 kg/cm$^2$ (60 psi or 0.03 tsi), 8.4 kg/cm$^2$ (120 psi or 0.06 tsi) 70.3 kg/cm$^2$ (0.5 tsi) to 2109.3 kg/cm$^2$ (15 tsi), or in the range of 140.6 kg/cm$^2$ (1 tsi) to 843.6 kg/cm$^2$ (6 tsi). The holding time within the press can be, for example, within the range of from less than 2.5 seconds to 1 minute.

Wheels may be molded individually or large "bats" can be molded, from which individual wheels are later cored out. The various abrasive mix layers, which comprise abrasive grain, resin and fillers), fiberglass reinforcement and barrier layer material are sequentially placed into a mold cavity in the appropriate configuration. The barrier layer can serve as the outermost layers of the stack. The full stack can be pressed using forces commensurate with the pressures described above. The barrier layer can adhere to the abrasive mixture, and thus ultimately be bonded in-situ to the abrasive wheel as a result of the curing process.

It will be appreciated however that warm pressing or hot pressing may be utilized to form the abrasive articles. Warm pressing and hot pressing are similar to cold pressing operations, except that higher temperatures may be utilized during the application of pressure.

In the embodiments employing an organic bond material, the bonded abrasive can be formed by curing the organic bond material. As used herein, the term "final cure temperature" is the temperature at which the molded article is held to effect polymerization, e.g., cross-linking, of the organic bond material, thereby forming the final composition of the bond material, although cross-linking can begin at lower temperatures. The curing temperature may be utilized during other processes, such as during the cold pressing operation. Alternatively, certain processes of the embodiments herein, can utilize a separate curing step, which can be separate from other processes such as the cold pressing operation. In such instances, the pressing operation may be first conducted, and the uncured abrasive article may be removed from the press and placed in a temperature-controlled chamber to facilitate curing. As used herein, "cross-linking" refers to the chemical reaction(s) that take(s) place in the presence of heat and often in the presence of a cross-linking agent, such as "hexa" or hexamethylenetetramine, whereby the organic bond composition hardens. Generally, the molded article can be held at a final cure temperature for a period of time, such as between 6 hours and 48 hours, between 10 and 36 hours, or until the center of mass of the molded article reaches the cross-linking temperature and desired grinding performance (e.g., density of the cross-link).

Selection of a curing temperature depends, for instance, on factors such as the type of bonding material employed, strength, hardness, and grinding performance desired. According to certain embodiments, the curing temperature can be in the range including at least 100° C. to not greater than 250° C. In more specific embodiments employing organic bonds, the curing temperature can be in the range including at least 150° C. to not greater than 230° C. Polymerization of novolac-based resins may occur at a temperature in the range of including at least 110° C. and not greater than 225° C. Resole resins can polymerize at a temperature in a range of including at least 100° C. and not greater than 225° C. Certain novolac resins suitable for the embodiments herein can polymerize at a temperature in a range including at least 110° C. and not greater than 250° C.

Barrier Layer

One or more barrier layers may be employed on the body of the bonded abrasive to facilitate improved performance of the abrasive tool. For example, the one or more barrier layers can be applied to particular surfaces of the body of the bonded abrasive to limit absorption of certain species (e.g., water) by the body, including for example, the bond material, which may facilitate improved performance of the abrasive tool.

According to an embodiment, the body of the bonded abrasive can be in close proximity with the barrier layer for construction of the abrasive tool disclosed herein. In particular embodiments, the barrier layer can be in direct contact with (i.e., abutting) at least one major surface of the bonded abrasive body. In an even more particular embodiment, the barrier layer can be directly bonded to at least one major surface of the bonded abrasive body, such that the barrier layer would not be separated from the bonded abrasive during operation of the abrasive tool.

Figure 2A:
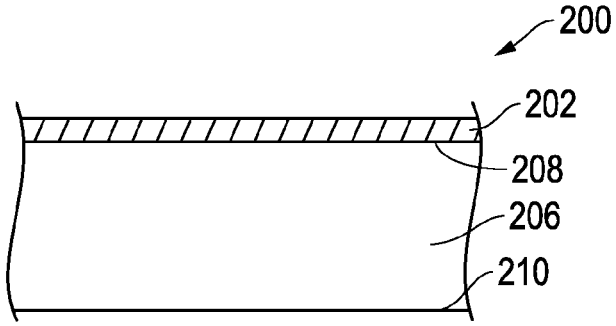
FIG. 2A includes a cross-sectional view of a portion of an abrasive tool including an abrasive layer and a barrier layer in accordance with an embodiment.
Figure 2B:
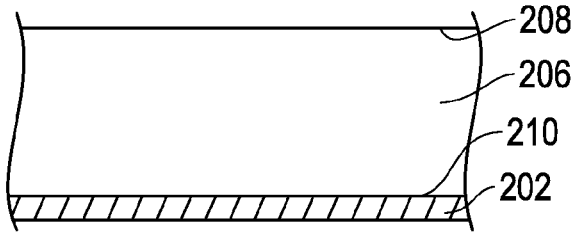
FIG. 2B includes a cross-sectional view of a portion of an abrasive tool including an abrasive layer and a barrier layer in accordance with an embodiment.
Figure 2C:
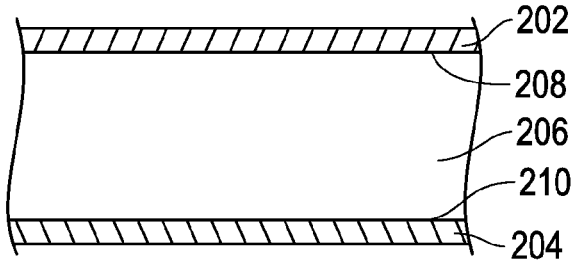
FIG. 2C includes a cross-sectional view of a portion of an abrasive tool including an abrasive layer and a barrier layer in accordance with an embodiment.

FIG. 2A includes a cross-sectional view of a portion of an abrasive tool according to an embodiment. The abrasive tool 200 includes the barrier layer 202 overlying the body 206 of the bonded abrasive. The body 206 includes major surfaces 208 and 210, among which barrier layer 202 abuts the major surface 208. In FIG. 2B, the body 206 can be on top of the barrier layer 202, and the major surface 210 is in direct contact with the barrier layer 202. Alternatively, the abrasive tool 200 can include more than one barrier layers. Furthermore, the barrier layer can be in direct contact with one or more major surfaces of the body of the bonded abrasive. FIG. 2C includes a cross-sectional view of a portion of a body of a bonded abrasive including a barrier layer according to an embodiment. As illustrated, the body 206 of the bonded abrasive can be disposed between a first barrier layer 202 and a second barrier layer 204. For example, the barrier layer 202 can be in direct contact with the major surface 208 and the barrier layer 204 can be in direct contact with the major surface 210.

Although the barrier layers 202 and 204 are illustrated to be single layers, it will be appreciated that the barrier layers 202 and 204 can include more than one layer (i.e., films) as described in embodiments herein.

Figure 3A:
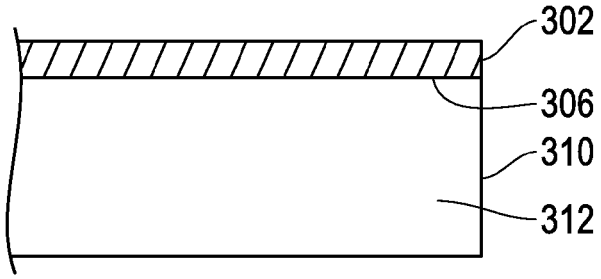
FIG. 3A includes a cross-sectional view of a portion of an abrasive tool including a barrier layer overlying an abrasive layer in accordance with an embodiment.
Figure 3B:
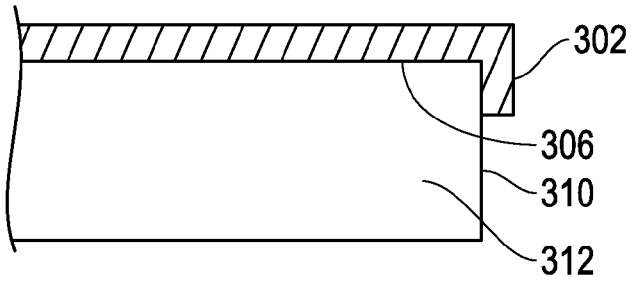
FIG. 3B includes a cross-sectional view of a portion of an abrasive tool including a barrier layer overlying an abrasive layer in accordance with an embodiment.
Figure 3C:
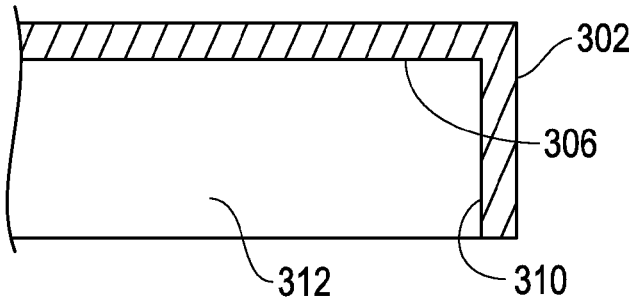
FIG. 3C includes a cross-sectional view of a portion of an abrasive tool including a barrier layer overlying an abrasive layer in accordance with an embodiment.

According to one embodiment, the barrier layer can overlie the entire surface area of the major surface of the body. In a further embodiment, the barrier layer may not extend over the peripheral surface that extends between the major surfaces of the body. In FIG. 3A, the barrier layer 302 can overly the major surface 306 of the bonded abrasive body 312 without extending over the peripheral surface of 310. In FIG. 3B, the barrier layer 302 can overlie the major surface 306 of the body 312 and extend over to at least a portion of the peripheral surface 310. Alternatively, the barrier layer 302 can overlie the major surface 306 and extend to overlie the entire surface areas of the peripheral surface 310 of the body 312. In accordance with these embodiments, it may not be necessary for the barrier layer to be removed prior to use of the abrasive tool. For example, the barrier layer can be removed during operation of the abrasive tool, such as grinding or cutting, without interfering with the process of operation. For another instance, the barrier layer can be formed such that forces encountered during applications of the abrasive tool can be sufficient to selectively remove at least a portion of the barrier layer to expose at least a portion of the work surface of the bonded abrasive. Removal of the barrier layer may occur without affecting the abrasive capabilities of the bonded abrasive.

According to an embodiment, the barrier layer can include a single layer or include more than one layer, wherein each discrete layer may be referred to as a film. According to an embodiment, the barrier layer can include a metal-containing film. The metal-containing film can include a metal or a metal alloy. Particularly, the metal can be selected from the group consisting of aluminum, iron, tin, copper, scandium, titanium, vanadium, chromium, manganese, nickel, zinc, yttrium, zirconium, niobium, molybdenum, silver, palladium cadmium, tantalum, tungsten, platinum, gold, and a combination thereof. The metal alloy can include an alloy including one or more of the metals disclosed herein. Moreover, the metal-containing film can consist essentially of any one of the metals noted above. Furthermore, the metal-containing film can consist essentially of a metal alloy made of two or more of the metals noted above.

According to another embodiment, the barrier layer can include a polymer-containing film. The polymer-containing film can include a polymer. In a particular embodiment, the polymer-containing film can consist essentially of a polymer. Examples of the polymer can include a thermoplastic, a thermoset, or the like. In a particular embodiment, the polymer can be selected from the group consisting of a thermoplastic and a thermoset. Examples of a thermoplastic can include poly(methyl methacrylate) (PMMA), polybenzimidazole, polyethylene, polypropylene, polystyrene, polyvinyl chloride, polytetrfluoroethylene, a thermoplastic elastomer, or any combination thereof. Examples of a thermoset can include polyester, polyurethanes, phenol-formaldehyde resin, an epoxy resin, polyimide, or any combination thereof. In a more particular embodiment, the polymer is selected from the group consisting of polyamide, polyester, polypropylene, polyvinyl, an epoxy, a resin, polyurethanes, a rubber, polyimide, phenolic, polybenzimidazole, aromatic polyamide, and a combination thereof. In a more particular embodiment, the polymer consists essentially of polyethylene terephthalate.

According to another embodiment, the barrier layer can include a biaxially-oriented material. Exemplary biaxially-oriented material can include polyester, such as polyethylene terephthalate. It will be appreciated that the barrier layer can consist essentially of any of the foregoing materials or consists essentially of two or more of the foregoing materials noted above. In a particular embodiment, the barrier layer can be essentially free of epoxy. In another particular embodiment, the barrier layer can be essentially free of paraffin. In still another particular embodiment, the barrier layer can be essentially free of a wax.

Figure 4A:
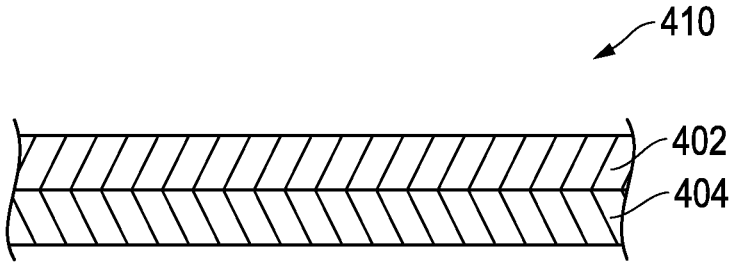
FIG. 4A includes a cross-sectional view of a portion of a barrier layer including a metal-containing film and a polymer containing film in accordance with an embodiment.
Figure 4B:
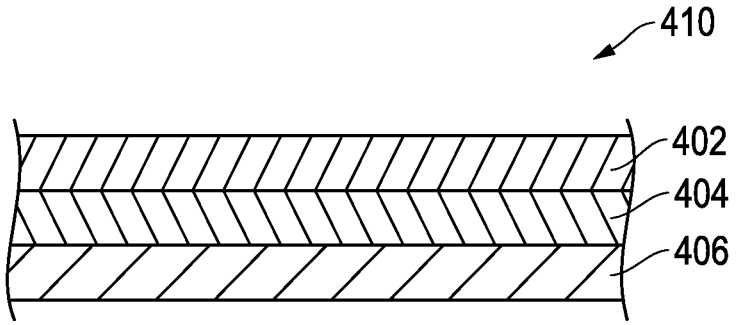
FIG. 4B includes a cross-sectional view of a portion of a barrier layer including more than one polymer-containing films and a polymer-containing film in accordance with an embodiment.
Figure 4C:
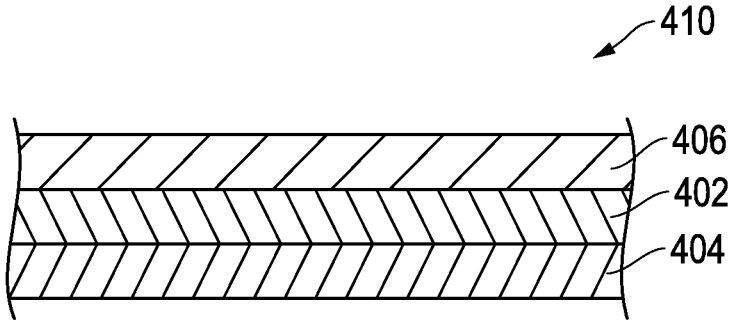
FIG. 4C includes a cross-sectional view of a portion of a barrier layer including more than one polymer-containing films and a polymer-containing film in accordance with an embodiment.

In some instances, the barrier layer can include more than one layer, such as a combination of the films in the embodiments herein. As shown in FIG. 4A, the barrier layer 410 can include the polymer-containing film 402 overlying the metal-containing film 404. Particularly, the polymer-containing film may be bonded directly to the metal-containing film, which may help to enhance structure stability of the barrier layer. The barrier layer may also include more than one metal-containing film, polymer-containing film, or a combination of multiple layers of these films. FIG. 4B to 4D include some exemplary configurations of the barrier layer 410. FIG. 4B depicts the metal-containing film 304 disposed between two polymer-containing films 402 and 406. In FIG. 4C, the polymer-containing film 402 is disposed between the polymer-containing film 406 and the metal-containing film 404, as shown in FIG. 4C. It will be appreciated that various combinations of one or more metal-containing films or polymer-containing films is within the scope of the present embodiments, and many other configurations of the barrier layer including one than one layer of the metal-containing films and the polymer-containing films would be possible and within the scope of the embodiments herein.

In accordance with a particular embodiment, the barrier layer can include a polymer-containing film disposed between a plurality of metal-containing layers, including for example, two metal-containing films. The two metal-containing films may include the same metal material, such as aluminum, however this is not always necessary. The polymer can include any of the polymers noted herein, including for example, polyethylene. Particularly, the barrier layer can be a double-sided reflective aluminum with polyethylene woven reinforcement disposed between the two layers of aluminum.

In accordance with another particular embodiment, the barrier layer can include a metal-containing film and a polymer-containing film. The polymer-containing film can be placed between the bonded abrasive body and the metal-containing film. In a more particular embodiment, the polymer-containing film can be in direct contact with the metal-containing film. In another more particular embodiment, the metal-containing film can be the outermost layer of the barrier layer.

In another particular embodiment, the barrier layer can include a plurality of films. The barrier layer can include a first polymer-containing film, a second polymer-containing film, a metal-containing film, a third polymer-containing film, and a fourth polymer-containing film. The first polymer-containing film can include biaxially-oriented nylon. The second polymer-containing film can include polyethylene. The metal-containing film can be foil. The third polymer-containing film can include polyethylene. The fourth polymer-containing film can include polyethylene, such as co-extruded polyethylene. In an even more particular embodiment, the fourth polymer-containing film can be the outermost layer of the barrier layer that is facing away from the bonded abrasive body. In another more particular body, the metal-containing film can be the outermost layer of the barrier layer. It will be appreciated that any of the foregoing films and the respective materials include films that consist essentially of the corresponding materials as noted above. For example, the fourth polymer-containing film can consist essentially of co-extruded polyethylene.

In the embodiments employing barrier layer including the metal-containing film and the polymer-containing film, the average thickness of these films can be similar or different. In some embodiments, the average thickness of the polymer-containing film can be greater than the average thickness of the metal-containing film. In other embodiments, the average thickness of the metal-containing film may be greater than the average thickness of the polymer-containing film.

According to an embodiment, the metal-containing film can be bonded to the major surface of the body, such that the metal-containing film can be in direct contact with the major surface of the body. In such an embodiment, the metal-containing film can be disposed between the major surface of the body and another film overlying the metal-containing film (e.g., a polymer-containing film). According to another embodiment, the polymer-containing film can be bonded to the major surface of the body, such that the polymer-containing film can be in direct contact with the major surface of the body. In such an embodiment, the polymer-containing film can be disposed between the major surface of the body and another film overlying the polymer-containing film (e.g., a metal-containing film). In a particular embodiment of the barrier layer including both metal-containing and polymer-containing films, the polymer-containing film can be directly bonded to the major surface of the body.

It has been noted that given the particular forming process of the embodiments herein, the barrier layer may be susceptible to damage, such as the formation of perforations that can extend through the thickness of the barrier layer (e.g., partially through the thickness or entirely through the thickness). During the process of forming the abrasive tool, perforations may be formed in the barrier layer. In addition, perforations may be formed during routine handling and shipping. The perforations can have similar or different sizes. For example, the perforations can have various sizes of diameters. In an embodiment, the perforation diameter can be at least 2 μm, such as 8 μm, at least 13 μm, at least 25 μm, at least 50 μm, at least 75 μm, at least 105 μm, at least 145 μm, at least 220 μm, or even at least 280 μm. In another embodiment, the perforation diameter of the perforations may not be greater than 1000 μm, such as not greater than 950 μm, not greater than 890 μm, not greater than 810 μm, not greater than 750 μm, not greater than 680 μm, not greater than 610 μm, not greater than 520 μm, or even not greater than 420 μm. It will be appreciated that the diameter of the perforations can be within a range including any of the minimum values and maximum values disclosed herein. For example, the can have the diameters of the perforations within a range of 2 μm to 1000 μm, such as within a range of 50 μm to 890 μm.

The perforations can have an average size, such as an average diameter. In an embodiment, the average diameter of the perforations can be at least 200 μm, at least 240 μm, at least 260 μm, at least 285 μm, or even at least 310 μm. In another embodiment, the average diameter may be not greater than 580 μm, such as not greater than 520 μm, not greater than 480 μm, not greater than 430 μm, or even not greater than 380 μm. It will be appreciated that the average diameter of the perforations can be within a range including any of the minimum values and maximum values noted above. For example, the perforations can have an average diameter within a range of 200 μm to 580 μm, such as within a range of 285 μm to 430 μm.

Density of perforation may be determined by counting the number of the perforations within randomly selected areas of a surface of the barrier layer that is facing away from the bonded abrasive body. At least 4 areas can be selected. Magnifiers or microscopes with backside illumination can be used to aid identifying the perforations. Perforation density can be the total number of perforations normalized by the total areas examined.

According to another embodiment, the perforation density may be not greater than not greater than 200 perforations/$cm^2$, such as not greater than 180 perforations/$cm^2$, not greater than 160 perforations/$cm^2$, not greater than 140 perforations/$cm^2$, not greater than 120 perforations/$cm^2$, not greater than 100 perforations/$cm^2$, not greater than 90 perforations/$cm^2$, not greater than 80 perforations/$cm^2$, not greater than 70 perforations/$cm^2$, not greater than 60 perforations/$cm^2$, not greater than 50 perforations/$cm^2$, not greater than 40 perforations/$cm^2$, not greater than 30 perforations/$cm^2$, not greater than 20 perforations/$cm^2$, not greater than 15 perforations/$cm^2$, not greater than 10 perforations/$cm^2$, not greater than 9 perforations/$cm^2$, not greater than 8 perforations/$cm^2$, not greater than 7 perforations/$cm^2$, not greater than 6 perforations/$cm^2$, or not greater than 5 perforations/$cm^2$, not greater than 4 perforations/$cm^2$, not greater than 3 perforations/$cm^2$, not greater than 2 perforations/$cm^2$, not greater than 1 perforation/$cm^2$. For at least one embodiment, the barrier layer can be essentially free of perforations. Still, in at least one non-limiting embodiment, some minor content of perforations can exist, such that the perforation density can be at least 0.1 perforations/$cm^2$, such as at least 0.5 perforations/$cm^2$, at least 1 perforation/$cm^2$, at least 1.5 perforations/$cm^2$, at least 1.8 perforations/$cm^2$, at least 2 perforations/$cm^2$, at least 2.3 perforations/$cm^2$, at least 2.5 perforations/$cm^2$, at least 3 perforations/$cm^2$, at least 3.5 perforations/$cm^2$, at least 4 perforations/$cm^2$, at least 4.5 perforations/$cm^2$, at least 5 perforations/$cm^2$, at least 5.6 perforations/cm$^2$, at least 6 perforations/cm$^2$, at least 6.5 perforations/cm$^2$, at least 7.2 perforations/cm$^2$, at least 8 perforations/cm$^2$, at least 9 perforations/cm$^2$, or even at least 10 perforations/cm$^2$. It will be appreciated that the perforation density can be within a range including any of the minimum values to maximum values noted above. For example, the perforation density can be within a range of 0.1 perforations/cm$^2$ to 200 perforations/cm$^2$, such as within a range of 0.5 perforations/cm$^2$ to 180 perforations/cm$^2$, within a range of 1 perforations/cm$^2$ to 160 perforations/cm$^2$, within a range of 2 perforations/cm$^2$ to 140 perforations/cm$^2$, within a range of 5 perforations/cm$^2$ to 120 perforations/cm$^2$, or within a range of 10 perforations/cm$^2$ to 100 perforations/cm$^2$.

In certain embodiments, orientation of the films of the barrier layer may affect the density of the perforation. It may be desired to have the polymer-containing film as the outermost layer for the barrier layer, as in some instances, depending upon the polymer-containing film material, during processing the material may exhibit a self-sealing capability configured to seal some perforations formed in the barrier layer. Notably, certain polymer-containing films may exhibit flow behaviors during processing that facilitate flowing and sealing of perforations formed during processing. For example, the polymer-containing film that includes co-extruded polyethylene may be disposed as the outmost layer in some embodiments to reduce perforation density of the barrier layer can be obtained.

In at least one other application, the polymer-containing film can be placed between the metal-containing film and the bonded abrasive body, which may help to reduce formation of perforation in the metal-containing film during the process of forming the abrasive tool. For instance, during curing, the material of the polymer-containing film may flow and seal at least some of the perforations formed in the metal-containing film. Additionally or alternatively, during processing, the material may facilitate flowing and sealing of perforations in the metal-containing film. The metal-containing film may be used as the outermost layer for the barrier layer.

Formation of the barrier layer can be carried out in-situ with the formation of the bonded abrasive (e.g. the abrasive wheel). Notably, the barrier layer can be selected such that it can withstand the forming process of forming the bonded abrasive. Moreover, the barrier layer may undergo some modification during the forming process, including for example, some physical or chemical changes that facilitate bonding of the barrier layer to one or more surfaces of the bonded abrasive body.

According to one particular forming process, the barrier layer can be disposed within the mold, on top of which an abrasive layer including abrasive particles contained in the bond material can be added in the manner in accordance with the embodiments herein. The abrasive layer can be in the form of the green body, mixture, various layers, or any other form described above. In certain instances, another barrier layer may be laid on top of the abrasive body. In some other embodiments, the barrier layer may be placed only adjacent to the bottom or top of the abrasive body. Moreover, a barrier layer may be placed in the mold such that it is adjacent the peripheral surface of the abrasive layer, such that the barrier layer can be formed on the peripheral surface of the bonded abrasive body.

In the embodiments of utilizing an organic bonding material to form the bond material, during curing of the organic bonding material, the barrier layer can adhere to one or more major surfaces of the body and/or a peripheral surface of the body.

In some embodiments, hot pressing can be used to form the bonded abrasive may be utilized for the barrier layer to directly bond to the major surface. The hot pressing operation can include parameters as detailed in the embodiments herein.

Certain temperature ranges may be particularly suitable to treat the barrier layer. For instance, the temperature can be at least 50° C., at least 100° C., or at least 150° C. In another instance, the temperature may be not greater than 250° C., not greater than 225° C., or not greater than 200° C. The temperature can be within any of the minimum and maximum values disclosed herein. For example, the temperature can be within a similar range of curing the abrasive wheel.

Embodiments disclosed herein represent a departure from state of the art abrasive articles. The barrier layer in accordance with the embodiments herein may be substantially impermeable, such as entirely impermeable, to moisture. Utilizing the barrier layers to reduce moisture absorption of the bonded abrasive may improve the performance of the abrasive tool over time and mitigate aging.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Embodiment 1. An abrasive tool comprising:

a bonded abrasive including a body comprising abrasive particles contained within a bond material; and a barrier layer bonded to at least a major surface of the body, the barrier layer comprising a metal-containing film.

Embodiment 2. The abrasive tool of embodiment 1, wherein the barrier layer comprises a polymer-containing film overlying the metal-containing film.

Embodiment 3. The abrasive tool of embodiment 1, wherein the barrier layer comprises a polymer-containing film bonded directly to the metal-containing film.

Embodiment 4. The abrasive tool of embodiment 1, wherein the barrier layer comprises a polymer-containing film consisting essentially of a polymer.

Embodiment 5. The abrasive tool of embodiment 1, wherein the polymer is selected from the group consisting of a thermoplastic and a thermoset.

Embodiment 6. The abrasive tool of embodiment 1, wherein the polymer is selected from the group consisting of polyamides, polyesters, polyethlyenes, polypropylene, polyvinyls, epoxies, resins, polyurethanes, rubbers, polyimides, phenolics, polybenzimidazole, aromatic polyamide, and a combination thereof.

Embodiment 7. The abrasive tool of embodiment 1, wherein the barrier layer comprises a biaxially-oriented material.

Embodiment 8. The abrasive tool of embodiment 1, wherein the barrier layer comprises a polymer including a biaxially-oriented material.

Embodiment 9. The abrasive tool of embodiment 8, wherein the polymer comprises polyethylene terephthalate or wherein the polymer consists essentially of polyethylene terephthalate.

Embodiment 10. The abrasive tool of embodiment 1, wherein the barrier layer comprises a polymer-containing film and wherein the polymer-containing film comprises an average thickness greater than an average thickness of the metal-containing film.

Embodiment 11. The abrasive tool of embodiment 1, wherein the barrier layer comprises a polymer-containing film and wherein the polymer-containing film comprises an average thickness less than an average thickness of the metal-containing film.

Embodiment 12. The abrasive tool of embodiment 1, wherein the barrier layer comprises a polymer-containing film and wherein the polymer-containing film is bonded directly to the major surface of the body.

Embodiment 13. The abrasive tool of embodiment 1, wherein the body comprises a first major surface and a second major surface opposite the first major surface, and a peripheral surface extending between the first major surface and the second major surface, and wherein the barrier layer is bonded directly to the first major surface and second major surface.

Embodiment 14. The abrasive tool of embodiment 13, wherein the barrier layer overlies at least a portion of the peripheral surface.

Embodiment 15. The abrasive tool of embodiment 13, wherein the barrier layer overlies the entire surface area of the first major surface and the second major surface.

Embodiment 16. The abrasive tool of embodiment 1, wherein the metal-containing film is in direct contact with the major surface of the body.

Embodiment 17. The abrasive tool of embodiment 1, wherein the metal-containing film comprises a metal or metal alloy.

Embodiment 18. The abrasive tool of embodiment 1, wherein the barrier layer consists essentially of the metal-containing film, wherein the barrier layer consists essentially of a single layer of the metal-containing film.

Embodiment 19. The abrasive tool of embodiment 1, wherein the metal-containing film comprises at least one metal selected from the group consisting of aluminum, iron, tin, copper, scandium, titanium, vanadium, chromium, manganese, nickel, zinc, yttrium, zirconium, niobium, molybdenum, silver, palladium cadmium, tantalum, tungsten, platinum, gold, and a combination thereof.

Embodiment 20. The abrasive tool of embodiment 1, wherein the abrasive particles include a material selected from the group consisting of oxides, nitrides, carbides, carbon-based materials, borides, oxynitrides, oxycarbides, oxyborides, naturally occurring minerals, and a combination thereof, and wherein the abrasive particles comprise shaped abrasive particles, wherein the abrasive particles comprise alumina.

Embodiment 21. The abrasive tool of embodiment 1, wherein the body comprises a filler contained within the bond, wherein the filler is selected from the group consisting of powders, granules, spheres, fibers, and a combination thereof, wherein the filler is selected from the group consisting of an inorganic material, an organic material, and a combination thereof, wherein the filler is selected from the group consisting of sand, bubble alumina, bauxite, chromites, magnesite, dolomites, bubble mullite, borides, titanium dioxide, carbon products (e.g., carbon black, coke or graphite), wood flour, clay, talc, hexagonal boron nitride, molybdenum disulfide, feldspar, nepheline syenite, glass spheres, glass fibers, CaF2, KBF4, Cryolite (Na3AlF6), potassium Cryolite (K3A1F6), pyrites, ZnS, copper sulfide, mineral oil, fluorides, carbonates, calcium carbonate, and a combination thereof, wherein the filler is selected from the group consisting of an antistatic agent, a metal oxide, a lubricant, a porosity inducer, coloring agent, and a combination thereof, wherein the filler is distinct from the abrasive particles.

Embodiment 22. The abrasive tool of embodiment 1, wherein the body comprises at least one reinforcing layer extending radially through at least a portion of the body, wherein the at least one reinforcing layer comprises a material selected from the group consisting of a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, and a combination thereof.

Embodiment 23. The abrasive tool of embodiment 1, wherein the body comprises a diameter (D) extending radially across the body and a thickness (t) extending axially across the body, wherein the body comprises a ratio of diameter:thickness of at least about 10:1 or at least about 20:1 or at least about 50:1, or at least about 100:1.

Embodiment 24. A method of forming an abrasive article comprising:

forming a barrier layer in-situ with the formation of a bonded abrasive including a body comprising abrasive particles contained within a bond material comprising an organic material.

Embodiment 25. The method of embodiment 24, wherein the barrier layer is adhered to a major surface of the body while the bond material is curing.

Embodiment 26. The method of embodiment 24, wherein the barrier layer is bonded directly to a major surface of the body using a hot pressing operation used to form the bonded abrasive body.

Embodiment 27. The method of embodiment 24, wherein the barrier layer is configured to be applied at a temperature within a range including at least 20° C. and not greater than 50° C., wherein the barrier layer is integrally bonded to the major surface, wherein the barrier layer is integrally bonded to the major surface during a cold pressing operation, wherein the barrier layer is integrally bonded to the major surface during curing of the bond material of the bonded abrasive.

Embodiment 28. The method of embodiment 24, wherein the barrier layer is applied during a hot pressing operation applying a force within a range between 40 tons and 2000 tons.

Embodiment 29. The abrasive tool of embodiment 1, wherein the barrier layer comprises a first metal-containing film, a second metal-containing film, and polymer-containing film, wherein the polymer-containing film is disposed between the first metal-containing film and the second metal containing film.

Embodiment 30. The abrasive tool of embodiment 29, wherein the first metal-containing film and the second metal-containing film comprise a same metal including aluminum and the polymer-containing film includes polyethylene woven reinforcement.

Embodiment 31. The abrasive tool of embodiment 1, further comprising a first polymer-containing biaxially-oriented nylon, a second polymer-containing film including polyethylene, a third polymer-containing film including polyethylene, and a fourth polymer-containing film including co-extruded polyethylene, wherein the metal-containing film includes foil.

Embodiment 32. The abrasive tool of embodiment 31, wherein the metal containing-film is an outermost film of the barrier layer.

Embodiment 33. The abrasive tool of embodiment 31, wherein the fourth polymer-containing film is an outermost layer of the barrier layer.

Embodiment 34. The abrasive tool of embodiment 1, wherein the barrier layer comprises a perforation density across a surface of the barrier layer, the perforation density being at least 0.1 perforations/$cm^2$, or at least 0.5 perforations/$cm^2$, or at least 1 perforations/$cm^2$, or at least 2/$cm^2$, or at least 5 perforations/$cm^2$, or at least 10 perforations/$cm^2$.

Embodiment 35. The abrasive tool of embodiment 1, wherein the barrier layer comprises a perforation density of not greater than 200 perforations/$cm^2$, or not greater than 180 perforations/$cm^2$, not greater than 160 perforations/$cm^2$, or not greater than 140 perforations/$cm^2$, or not greater than 120 perforations/$cm^2$, or not greater than 100 perforations/$cm^2$.

Embodiment 36. The abrasive tool of embodiment 1, wherein the barrier layer comprises a perforation density across a surface of the barrier layer within a range of 0.1 perforations/$cm^2$ to 200 perforations/$cm^2$, or within a range of 0.5 perforations/$cm^2$ to 180 perforations/$cm^2$, or within a range of 1 perforation/$cm^2$ to 160 perforations/$cm^2$, or within a range of 2 perforations/$cm^2$ to 140 perforations/$cm^2$, or within a range of 5 perforations/$cm^2$ to 120 perforations/$cm^2$, or within a range of 10 perforations/$cm^2$ to 100 perforations/$cm^2$.

EXAMPLE 1

A conventional abrasive bonded abrasive wheel A and abrasive wheels representative of the embodiments herein with different barrier layers (wheels B to F) were tested to determine the effect of moisture on the performance. Wheels A to F were formed by the method of cold pressing including application of a pressure within a range of 90-120 bar at approximately room temperature. Then, all wheels were stacked and cured in an oven at approximately 200° C. Wheels A to F were Type 41 wheels having a structure of barrier layer/fiberglass reinforcement /abrasive mix/fiberglass reinforcement/barrier layer. The abrasive mix contained 40 vol % 46 grit ceramic-coated brown fused alumina, 34.5 vol % resin (resole and novolac), 5.75 vol % each of potassium aluminum fluoride and potassium sulfate and 14% porosity. The barrier layers of wheels B to F included different combinations of the polymer-containing films and metal-containing films described in embodiments herein. The orientation of the films for each barrier layer is provided herein in the order from the outmost layer to the innermost layer. The barrier layer of wheel B included a biaxially-oriented nylon film, a polyethylene film, a foil, another polyethylene film, and a film of co-extruded polyethylene. The barrier layer of wheel C included an oriented polypropylene film, a polyethylene film, a foil, and another polyethylene film. Wheel D included a barrier layer including double sided reflective aluminum with polyethylene woven reinforcement disposed between the aluminum films. The barrier layer of wheel E included aluminum foil. The barrier layer of wheel F included a low density polyethylene film. Further Information of the barrier layers of wheels B to F are provided in Table 1 below.

TABLE 1

| Samples | Moisture Vapor Transmission Rate at 25 C. 90% RH (WVTR g/$m^2$/day) | Perforation Density (/$cm^2$) |
|---|---|---|
| B | <0.00775 | 19.6 |
| C | <0.31 | 101 |
| D | <0.01 | 8.7 |
| E | NA | very high |
| F | <22.1 | not measured |

Figure 5:
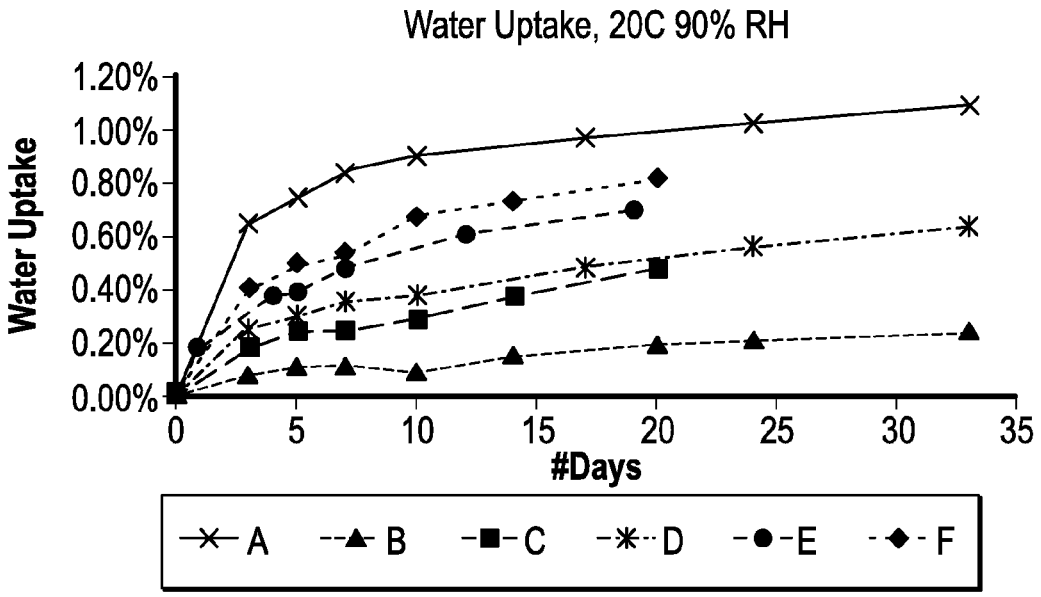
FIG. 5 includes a plot of moisture uptake of bonded abrasive wheel samples over a period of time.

All the abrasive wheels were 125×1.6×22.3 mm and exposed to the same aging conditions of 90% relative humidity. The abrasive wheels A, B, and D were exposed to the aging condition for 33 days, and the abrasive wheels C, E, and F were exposed for 20 days. Moisture uptake of each wheel was measured on different days and illustrated in FIG. 5. At day 5, moisture uptake in the conventional abrasive wheel A was measured to be 0.75% by weight, while wheels B to F only had approximately 0.10%, 0.25%, 0.30%, 0.40%, and 0.50% of moisture uptake, respectively. At day 10, moisture uptake of the conventional wheel A increased to greater than approximately 0.90%, and reached approximately 1.00% at day 20. Wheels B to F had approximately 0.10%, 0.30%, 0.40%, 0.50%, and 0.70% of moisture uptake, respectively, at day 10, and approximately 0.20%, 0.55%, 0.55%, ~0.70%, and 0.80%, respectively at day 20. At day 33, wheel A had 1.10% of moisture uptake, but wheel B and D only had approximately 0.25% and 0.65% of moisture uptake, respectively.

Figure 6:
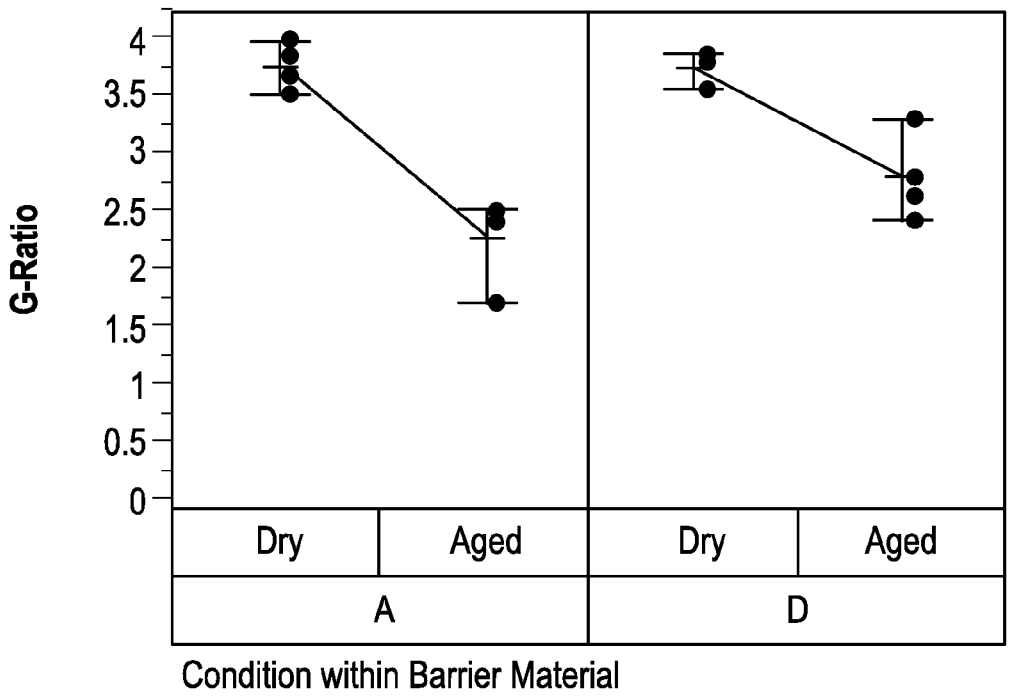
FIG. 6 includes a plot of G-ratios of bonded abrasive wheel samples.

Wheel aging and performance degradation was observed in association with moisture uptake. Before and after the aging test, wheels A and D were subjected to G-ratio tests. As illustrated in FIG. 6, wheel A had a G-ratio decrease of 39% after the aging test compared to before the aging test, while G-ratio of wheel D only dropped 25% after the aging test compared to before the aging test. Thus wheel D and its particular barrier layer demonstrated a 14% increase in G-ratio compared to the standard wheel (wheel A) with no barrier layer.

EXAMPLE 2

Figure 7:
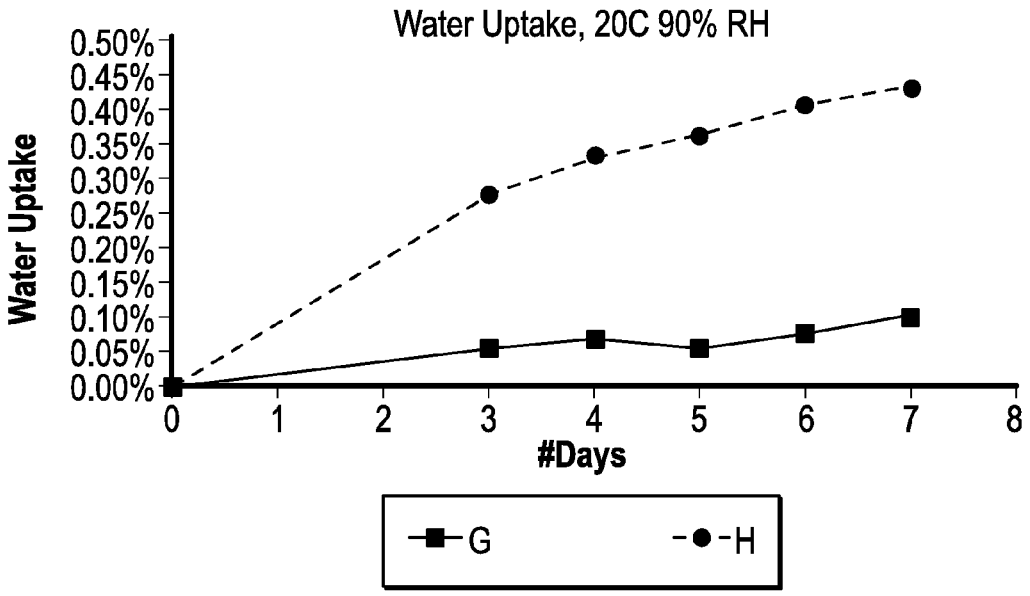
FIG. 7 includes a plot of moisture uptake of bonded abrasive wheel samples over a period of time.
Figure 8:
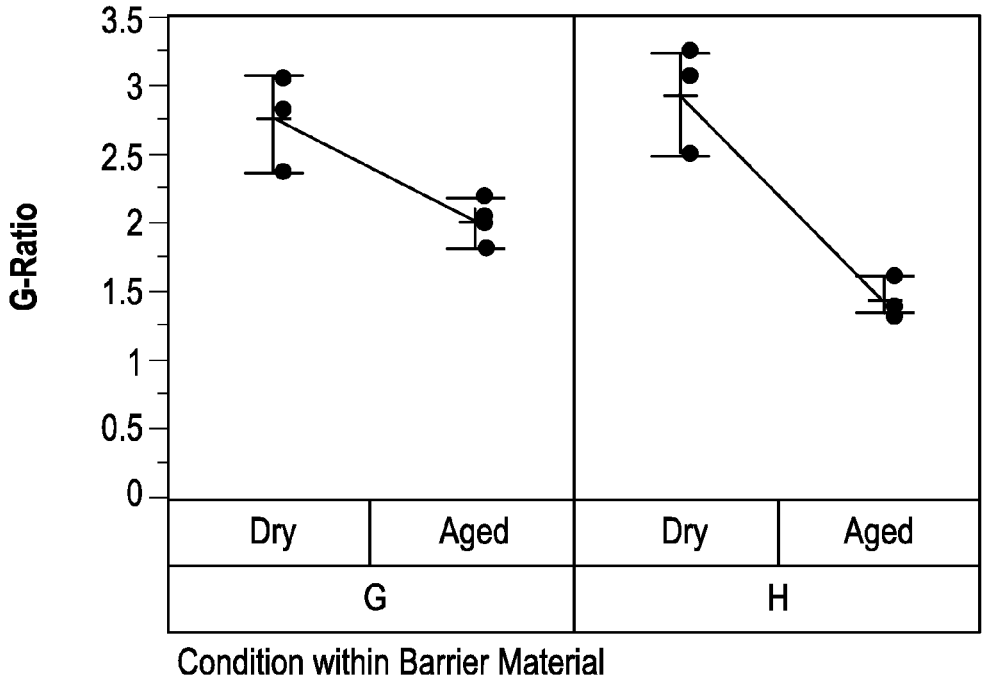
FIG. 8 includes a plot of G-ratios of bonded abrasive wheel samples.

Wheels G and H were formed in accordance with the embodiments herein. The barrier layers of wheels G and H both included a film of biaxially-oriented nylon, a polyethylene film, a film of foil, another polyethylene film, and a film of co-extruded polyethylene. In wheel G, the biaxially-oriented nylon was the outmost layer (facing away from the bonded abrasive body) of the barrier layer, while in wheel H, the film of co-extruded polyethylene, covered with an additional black paper were the outermost layers. Wheels G and H were exposed to the same aging conditions of 90% relative humidity for 7 days. As shown in FIG. 7 and Table 2 below, orientation of the films of the barrier layer had an impact on moisture uptake of the wheels. FIG. 8 includes a plot of G-ratio tests of wheels G and H conducted before and after the aging test. The G-ratio of aged wheel G decreased 27% compared to that before the aging test. The G-ratio of aged wheel H decreased 50% compared to that before the aging test. Therefore, as indicated by the data, the orientation of the barrier layer as well as the type of material can have an effect on limiting the ageing of the wheels.

TABLE 2

| | Wheel G | Wheel H |
|---|---|---|
| Day 3 | 0.06% | 0.28% |
| Day 4 | 0.07% | 0.33% |
| Day 5 | 0.06% | 0.38% |
| Day 6 | 0.08% | 0.40% |
| Day 7 | 0.10% | 0.43% |

EXAMPLE 3

A conventional bonded abrasive wheel MMB1 and abrasive wheels representative of the embodiments herein with different barrier layers (wheels MMB2, MMB3, MMB4, MMB5, MMB6, MMB17, and MMB20) were tested to determine the effect of compositions of the barrier layer on moisture uptake into the bonded abrasive wheel. All the wheels were formed by the method of cold pressing utilizing a cold pressing machine (e.g., 350 Ton Press manufactured by Poggi Pasqualino) and the pressure in the press was kept within a range of 90-120 bar (corresponding to 9 MPa to 12 MPa) at approximately room temperature. Then, the barrier layers were place around the wheels to make the wheel samples noted in Table 3. No barrier layer was applied to wheel MMB1. The wheels were then cured in an oven at approximately 200° C. 10 perforations were formed in the barrier layer of each side of wheel MMB6 by puncturing the aluminum film with a pin. The compositions and thickness of the barrier layers are included in Table 3. All the abrasive wheels were 125×1.6×22.3 mm and exposed to aging conditions as indicated in Table 3. The weight change from prior to moisture exposure to after being exposed to 90% relative humidity at 25° C. for 7 days was measured and compared to the original weight for each wheel.

TABLE 3

| Wheels | Barrier Composition | Barrier Thickness (mil) | Moisture Vapor Transmission Rate | Moisture Uptake |
|---|---|---|---|---|
| MMB1 | None | N/A | Not Measured | 0.83% |
| MMB2 | Biaxially Orientated Nylon/PE/Foil/PE/Heavy Duty Coextruded Polyethylene | 7.3 | 0.00775 g/m$^2$/day (90% relative humidity at 40° C.) | 0.09% |
| MMB3 | Biaxially Nylon/PE/Cross Laminated PE/PE/Foil/ Heavy Duty Coextruded Polyethylene | 10.3 | 0.00775 g/m$^2$/day (90% relative humidity at 40° C.) | 0.04% |
| MMB4 | Aluminum/ Polyethylene Woven Reinforcement/ Aluminum | 4.5 | 0.013 g/m$^2$/day (100% relative humidity at 25° C.) | 0.14% |
| MMB5 | Aluminum (no visible perforations) | 0.64 | <0.005 g/m$^2$/day (100% relative humidity at 37.8° C.) | 0.24% |
| MMB6 | Aluminum (10 perforations/film) | 0.64 | Not Measured | 0.3% |
| MMB17 | Silane Treated Black PTFE | 4.2 | 1.91 g/m$^2$/day (100% relative humidity at 37.8° C.) | 0.17% |
| MMB20 | Silane Treated Clear PTFE | 1 | 8.9 g/m$^2$/day (100% relative humidity at 37.8° C.) | 0.45% |

As disclosed in Table 3, wheel MMB2 had the barrier layer including a biaxially-orientated nylon film, polyethylene (PE) film, foil, PE film, and heavy duty coextruded polyethylene film with the biaxially orientated Nylon film as the outermost layer. The barrier layer of MMB2 had reduced moisture uptake, 0.09% as compared to 0.83% of the conventional sample, MMB1. The barrier layer of wheel MMB3 included a biaxially-orientated nylon film, PE film, cross-laminated PE film, PE film, Foil, and heavy duty coextruded polyethylene with the biaxially orientated nylon film as the outermost layer. Wheel MMB3 had similarly low moisture uptake as MMB2. The barrier layer of wheel MMB4 included a double sided reflective aluminum film, polyethylene woven reinforcement and a second double sided reflective aluminum film. Wheel MMB4 demonstrated reduced moisture uptake as compared to wheel MMB1 (0.14% vs. 0.83%). The barrier layer of MMB5 included an aluminum film without pinholes, and wheel MMB5 had a moisture uptake of 0.24%. The aluminum film on each side of the abrasive body of wheel MMB6 had 10 pinholes, and the MMB6 wheel had moisture uptake of 0.3%. Wheel MMB17 had the barrier layer of a silane treated black PTFE film and moisture uptake of 0.17%. Wheel MMB9 had the barrier layer of a silane treated clear PTFE film and moisture uptake of 0.45%.

Certain attempts have been made to reduce the effects of ageing, including placing bonded abrasive articles in bags or coating the surfaces of the bonded abrasives with wax or resinous materials to seal the surfaces. However, the embodiments herein represent a departure from these techniques, and in particular, the embodiments herein facilitate efficient and large-scale manufacturing of bonded abrasive articles. Notably, in-situ formation of a barrier layer was found to be a non-trivial investigation and that one or more features of the barrier layer in combination with the bonded abrasive were found remarkable and/or unexpected, including features such as the material of the barrier layer, the water vapor transmission rate of the barrier layer, the structure and grade of the bonded abrasive, the orientation of the barrier layer relative to the bonded abrasive, the puncture density, and the like.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive tool comprising:

a bonded abrasive including a body comprising abrasive particles contained within a bond material; and a barrier layer bonded to at least a major surface of the body, the barrier layer comprising a metal-containing film and further comprising a first polymer-containing film including biaxially-oriented nylon, a second polymer-containing film including polyethylene, a third polymer-containing film including polyethylene, and a fourth polymer-containing film including co-extruded polyethylene, wherein the metal-containing film includes foil.

2. The abrasive tool of claim 1, wherein the barrier layer comprises a polymer-containing film overlying the metal-containing film.

3. The abrasive tool of claim 2, wherein the barrier layer comprises a perforation density across a surface of the barrier layer within a range of 0.1 perforations/$cm^2$ to 200 perforations/$cm^2$.

4. The abrasive tool of claim 1, wherein at least one of the first, second, third, and fourth polymer-containing films is bonded directly to the metal-containing film.

5. The abrasive tool of claim 1, wherein one of the first, second, third, and fourth polymer-containing films is bonded directly to the major surface of the body.

6. The abrasive tool of claim 1, wherein the body comprises a first major surface and a second major surface opposite the first major surface, and a peripheral surface extending between the first major surface and the second major surface, and wherein the barrier layer is bonded directly to the first major surface and second major surface.

7. The abrasive tool of claim 6, wherein the barrier layer overlies at least a portion of the peripheral surface.

8. The abrasive tool of claim 1, wherein the metal-containing film is in direct contact with the major surface of the body.

9. The abrasive tool of claim 1, wherein the first polymer-containing film is an outermost layer of the barrier layer facing away from the body, the forth polymer-containing film is an innermost layer in contact with the major surface of the body, and the metal-containing film is disposed between the second and third polymer-containing films.

10. An abrasive tool comprising:

a bonded abrasive including a body comprising:

abrasive particles contained within a bond material;

a first major surface and a second major surface opposite the first major surface; and a peripheral surface extending between the first major surface and the second major surface, wherein a barrier layer is bonded directly to the first major surface and the second major surface; and wherein the barrier layer comprises a metal-containing film, a first polymer-containing film including a biaxially-oriented material, a second polymer-containing film, and a third polymer-containing film including polyethylene, wherein the metal containing film is disposed between the second and the third polymer-containing films.

11. The abrasive tool of claim 10, wherein the first polymer-containing film including the biaxially-oriented material is an outermost layer of the barrier layer, and the third polymer-containing film is an innermost layer of the barrier layer.

12. A method of forming an abrasive article comprising:

forming a barrier layer in-situ with the formation of a bonded abrasive including a body comprising abrasive particles contained within a bond material comprising an organic material, the barrier layer comprising a metal-containing film and further comprising a first polymer-containing biaxially-oriented nylon, a second polymer-containing film including polyethylene, a third polymer-containing film including polyethylene, and a fourth polymer-containing film including co-extruded polyethylene, wherein the metal-containing film includes foil.

13. The method of claim 12, wherein the barrier layer is adhered to a major surface of the body while the bond material is curing.

14. The method of claim 12, wherein the barrier layer is bonded directly to a major surface of the body using a hot pressing operation used to form the bonded abrasive body.

15. The method of claim 12, wherein the barrier layer is integrally bonded to the major surface during a cold pressing operation, or wherein the barrier layer is integrally bonded to the major surface during curing of the bond material of the bonded abrasive.

16. The method of claim 12, wherein the barrier layer is applied during a hot pressing operation applying a force within a range between 40 tons and 2000 tons.

17. The abrasive tool of claim 10, wherein the biaxially-oriented material comprises nylon, polypropylene, or polyester.

18. The abrasive tool of claim 17, wherein the biaxially-oriented material comprises polyethylene terephthalate, or wherein the biaxially-oriented material consists essentially of polyethylene terephthalate.

19. The abrasive tool of claim 10, wherein the second polymer-containing film comprises a polymer selected from the group consisting of a thermoplastic and a thermoset.

20. The abrasive tool of claim 19, wherein the polymer is selected from the group consisting of polyamides, polyesters, polyethlyenes, polypropylene, polyvinyls, epoxies, resins, polyurethanes, rubbers, polyimides, phenolics, polybenzimidazole, aromatic polyamide, and a combination thereof.

* * * * *